US012543814B2

(12) United States Patent
Brown et al.

(10) Patent No.: US 12,543,814 B2
(45) Date of Patent: Feb. 10, 2026

(54) ARTICLES OF FOOTWEAR WITH KNITTED COMPONENTS AND METHODS OF MANUFACTURING THE SAME

(71) Applicant: NIKE, Inc., Beaverton, OR (US)

(72) Inventors: Gemma Brown, Beaverton, OR (US); Chaokun Huangfu, Portland, OR (US); James Molyneux, Portland, OR (US); Kristen E. Orme, Portland, OR (US); Peter R. Savage, Aloha, OR (US); Gagandeep Singh, Haeundae-gu (KR); Seth M. Wiberg, Beaverton, OR (US); Roberto Zavala, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/970,951

(22) Filed: Oct. 21, 2022

(65) Prior Publication Data

US 2023/0126432 A1 Apr. 27, 2023

Related U.S. Application Data

(60) Provisional application No. 63/270,987, filed on Oct. 22, 2021, provisional application No. 63/389,617, filed on Jul. 15, 2022.

(51) Int. Cl.
*A43B 1/04* (2022.01)
*A43B 23/02* (2006.01)
(Continued)

(52) U.S. Cl.
CPC ..... *A43B 1/04* (2013.01); *A43B 23/0245* (2013.01); *D04B 1/108* (2013.01); *D04B 1/26* (2013.01)

(58) Field of Classification Search
CPC ..... A43B 1/04; A43B 23/042; A41B 11/004; D04B 1/26; D04B 1/265; D04B 1/108
See application file for complete search history.

(56) References Cited

U.S. PATENT DOCUMENTS 2,047,724 A 7/1936 Zuckerman
2,400,692 A * 5/1946 Herbert ..... D04B 1/108 66/171

(Continued)

FOREIGN PATENT DOCUMENTS

CN 206197216 U 5/2017
CN 111549434 A 8/2020

(Continued)

OTHER PUBLICATIONS

International Search Report and Written Opinion received for PCT Patent Application No. PCT/US2022/047504, mailed on Apr. 3, 2023, 20 pages.

(Continued)

*Primary Examiner* — Megan E Lynch
(74) *Attorney, Agent, or Firm* — Shook, Hardy & Bacon L.L.P.

(57) ABSTRACT

A knitted component having an outer perimeter and a common portion, which may be a centrally-located region, such as a throat region and/or a collar region. A plurality of courses of the knitted component extend between the outer perimeter and the common portion such that the courses may be radially-extending outwards from the common portion. One or more continuous strand may be inlaid within the knit courses to form a plurality of strand segments that extend within respective ones of the plurality of courses of the knitted component between the outer perimeter and the common portion of the knitted component.

24 Claims, 22 Drawing Sheets

(51) Int. Cl.
*D04B 1/10* (2006.01)
*D04B 1/26* (2006.01)

(56) References Cited

U.S. PATENT DOCUMENTS

| | | | | |
|---|---|---|---|---|
| 9,078,488 | B1 | 7/2015 | Meir et al. | |
| 10,398,196 | B2 | 9/2019 | Minami et al. | |
| 11,168,416 | B2 | 11/2021 | Huffa et al. | |
| 2004/0118018 | A1 | 6/2004 | Dua | |
| 2005/0115284 | A1* | 6/2005 | Dua | D04B 1/102 66/178 R |
| 2012/0233882 | A1* | 9/2012 | Huffa | A43C 1/00 36/45 |
| 2014/0245633 | A1 | 9/2014 | Podhajny | |
| 2014/0245634 | A1 | 9/2014 | Podhajny | |
| 2015/0075031 | A1 | 3/2015 | Podhajny et al. | |
| 2015/0272274 | A1* | 10/2015 | Berns | A43B 23/027 36/84 |
| 2015/0289592 | A1* | 10/2015 | Song | A43B 7/085 36/47 |
| 2015/0351483 | A1 | 12/2015 | Podhajny | |
| 2016/0029736 | A1* | 2/2016 | Meir | A43B 1/04 66/170 |
| 2016/0058099 | A1* | 3/2016 | Panian | A43B 23/0265 66/170 |
| 2016/0058100 | A1* | 3/2016 | Dealey | D04B 1/16 12/142 G |
| 2016/0088899 | A1* | 3/2016 | Liles | A43C 1/04 36/50.1 |
| 2016/0174660 | A1* | 6/2016 | Iuchi | A43B 23/0205 36/45 |
| 2016/0255913 | A1* | 9/2016 | Uchikawa | D04B 1/22 |
| 2016/0302527 | A1* | 10/2016 | Meir | D04B 1/102 |
| 2016/0331083 | A1* | 11/2016 | Uesato | A43C 1/04 |
| 2017/0325547 | A1* | 11/2017 | Cai | D05B 37/00 |
| 2019/0037968 | A1* | 2/2019 | DeWillie | D04B 21/207 |
| 2019/0116914 | A1 | 4/2019 | Schoppel et al. | |
| 2019/0223541 | A1 | 7/2019 | Aceves et al. | |
| 2019/0274392 | A1 | 9/2019 | Amis et al. | |
| 2019/0365049 | A1* | 12/2019 | Verfl | A43B 1/04 |
| 2020/0022456 | A1* | 1/2020 | Brinkman | A43B 1/04 |
| 2020/0029655 | A1* | 1/2020 | Nishiwaki | A43B 23/0255 |
| 2020/0046074 | A1 | 2/2020 | Berrian et al. | |
| 2022/0256962 | A1 | 8/2022 | Dekovic et al. | |
| 2022/0259780 | A1 | 8/2022 | Green et al. | |
| 2023/0323574 | A1 | 10/2023 | McFarland et al. | |

FOREIGN PATENT DOCUMENTS

| | | | | |
|---|---|---|---|---|
| CN | 113331530 | A | 9/2021 | |
| CN | 113367448 | A | 9/2021 | |
| CN | 113403735 | A | 9/2021 | |
| EP | 2199444 | A1 * | 6/2010 | D04B 1/108 |
| GB | 547900 | A * | 9/1942 | |
| GB | 661947 | A * | 11/1951 | |
| GB | 1149724 | A * | 4/1969 | |
| JP | 2016-516458 | A | 6/2016 | |
| JP | 2016-529036 | A | 9/2016 | |
| TW | I520690 | B | 2/2016 | |
| TW | 201636470 | A | 10/2016 | |
| TW | 201726014 | A | 8/2017 | |
| TW | 202042692 | A | 12/2020 | |
| TW | 202118410 | A | 5/2021 | |
| TW | 202207832 | A | 3/2022 | |
| TW | 202216001 | A | 5/2022 | |
| WO | 2014/137826 | A1 | 9/2014 | |
| WO | WO-2016018904 | A1 * | 2/2016 | A43B 1/04 |
| WO | 2016/168046 | A2 | 10/2016 | |

OTHER PUBLICATIONS

International Search Report and Written Opinion received for PCT Patent Application No. PCT/US2022/047505, mailed on Apr. 4, 2023, 18 pages.

Invitation to Pay Additional Fees received for PCT Patent Application No. PCT/US2022/047504, mailed on Feb. 10, 2023, 15 pages.

Invitation to Pay Additional Fees received for PCT Patent Application No. PCT/US2022/047505, mailed on Feb. 14, 2023, 13 pages.

Non-Final Office Action received for U.S. Appl. No. 17/971,309, mailed on Sep. 29, 2024, 9 pages.

Communication pursuant to Rules 161(1) and 162 EPC received for European Application No. 22812904.5, mailed on May 29, 2024, 3 pages.

European search report received for European Application No. 24176260.8, mailed on Aug. 9, 2024, 10 pages.

Notice of Allowance received for U.S. Appl. No. 17/971,309, mailed on Apr. 29, 2025, 8 pages.

Notice of Allowance received for U.S. Appl. No. 17/971,309, mailed on May 14, 2025, 2 pages.

* cited by examiner

ARTICLES OF FOOTWEAR WITH KNITTED COMPONENTS AND METHODS OF MANUFACTURING THE SAME

CROSS-REFERENCE TO RELATED APPLICATIONS AND PRIORITY CLAIM

This non-provisional patent application claims priority to U.S. provisional patent app. Ser. No. 63/270,987, filed on Oct. 22, 2021, and titled "Articles of Footwear with Knitted Components and Methods of Manufacturing the Same," and claims priority to U.S. provisional patent app. Ser. No. 63/389,617, filed on Jul. 15, 2022, and titled "Articles of Footwear with Knitted Components and Methods of Manufacturing the Same." The contents of both of the aforementioned applications are herein incorporated by reference in the entirety. This application is also related by subject matter to U.S. patent application Ser. No.17/971,300, filed on Oct. 21, 2022, the entire contents of which is incorporated herein by reference.

FIELD

Aspects herein relate to knitted components and methods of manufacturing knitted components for articles, e.g., articles of footwear.

BACKGROUND

Conventional articles of footwear generally include two primary elements: an upper and a sole structure. The upper is secured to the sole structure and forms a void within the footwear for comfortably and securely receiving a foot. Uppers may be formed from a variety of materials, including knitted textiles. When an athlete moves their foot within a knitted upper, a force may be exerted on the athlete's foot that pushes the foot partially off the sole structure. Performance and comfort may be improved by keeping the foot contained over the sole structure during movement. The amount and location of containment needed may vary based on the activity. Various components may be added to a knitted upper through post-knitting processes to keep the foot contained. However, such components added post-knitting may increase the weight of the upper, increase production time, and reduce recyclability of the upper.

BRIEF DESCRIPTION OF THE DRAWINGS

The subject matter of this disclosure related to knitted components, articles with the same, and methods of manufacturing and using the same, is discussed in connection with the attached drawing figures, which are intended to represent non-limiting examples, wherein.

DETAILED DESCRIPTION

Figure 1:
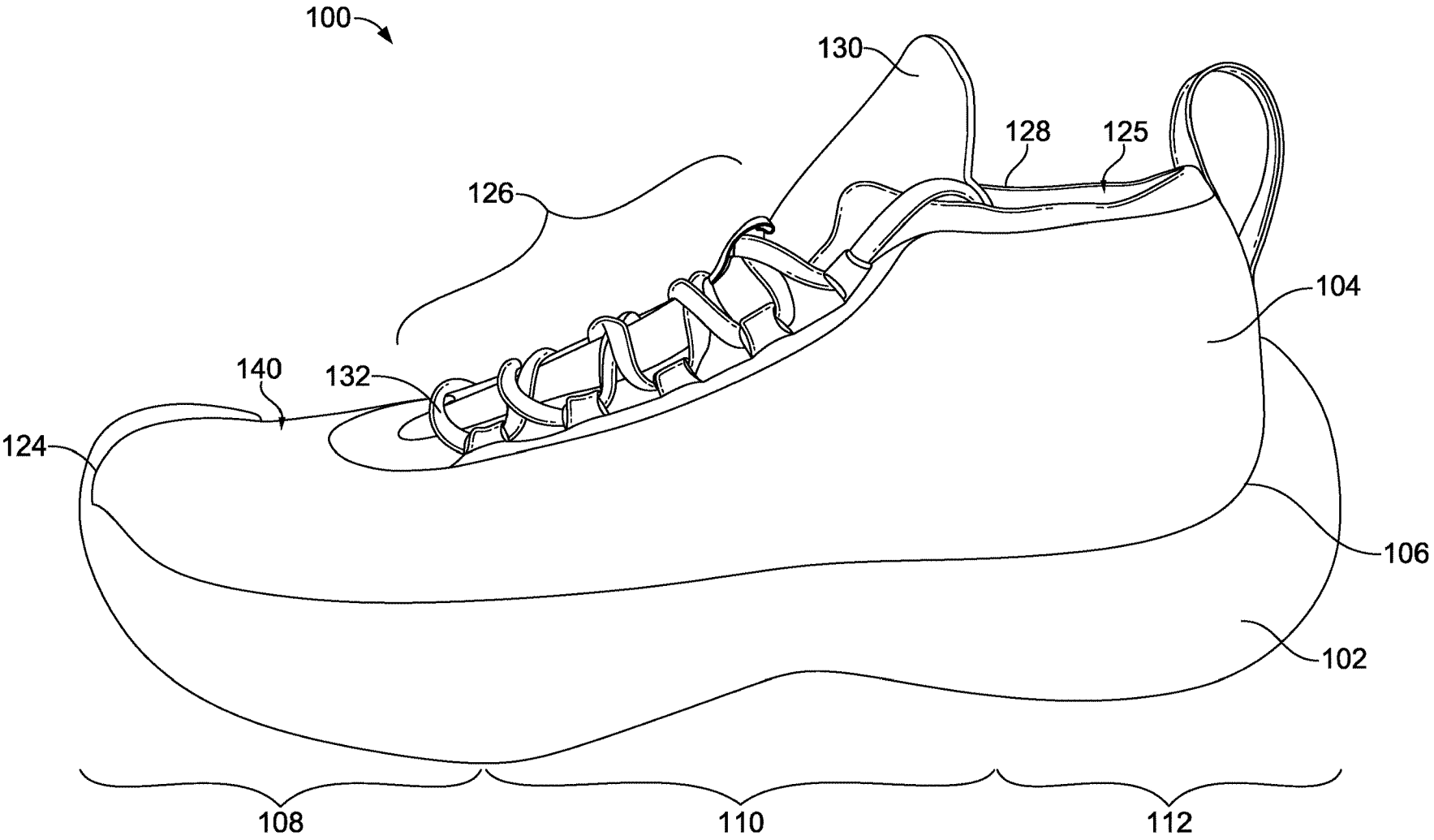
FIG. 1 depicts a side view of an example article of footwear formed with a knitted component, in accordance with aspects hereof.

The subject matter of this disclosure is described with specificity herein to meet statutory requirements. However, the description itself is not intended to limit the scope of the invention. Rather, the claimed or disclosed subject matter might also be embodied in other ways, to include different features, different combinations of features, different steps, and/or different combinations of steps similar to the ones described in this document, and in conjunction with other present or future technologies or solutions. Moreover, although the terms "step" and/or "block" might be used herein to identify different elements of methods employed, the terms should not be interpreted as implying any particular order among or between various steps herein disclosed unless and except when the order of individual steps is explicitly stated.

Conventional articles of footwear generally include an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The upper of the article of footwear generally extends over the instep and toe areas of the foot, along the medial and lateral sides of the foot, and around the heel area of the foot. Access to the void on the interior of the upper is generally provided by an ankle opening in a heel area of the footwear, and a lacing system may be incorporated to adjust the fit of the upper.

Uppers may be formed with a variety of materials, including knitted textiles having intermeshed loops of yarn. Uppers formed by knitted textiles may be breathable, lightweight, and flexible. However, traditional knitted uppers may lack structure provided with other types of materials. Consequently, as an athlete moves their foot, a force may be exerted that pushes the foot within a traditional knitted upper off of the sole structure of the footwear. Performance and comfort can be improved by keeping the foot contained over the sole structure during movement. Various components may be added to a knitted upper through post-knitting processes to keep the foot contained. However, such components added post-knitting may increase the weight of the upper, increase production time, and/or reduce recyclability of the upper. Further, the amount and location of containment that is needed may vary based on the activity. However, traditional knitting processes for footwear often do not achieve a level of containment and/or a direction of containment desired or suitable for certain activities, and thus, additional components and/or post-knitting processes can be needed to achieve a necessary or suitable level of containment.

In summary, and at a high level, aspects of this disclosure are directed to a knitted component for an upper forming at least a forefoot region and a midfoot region either or both of which may include one or more radially-extending knit courses that extend between an outer perimeter and a common portion. The common portion of the knitted component may be a central region along or adjacent to at least part of the longitudinal axis of the knitted component, such as the throat region. Because knit courses in the midfoot and/or forefoot regions extend between different sections of the outer perimeter and a common portion, at least some radially-extending courses may not run parallel to each other, or in other words, may extend at angles relative to each other. However, immediately adjacent course portions can be substantially parallel, e.g., such as course portions that are immediately adjacent and that are the same or different lengths. In some aspects, the knitted component includes a heel region that is integrally knit with the midfoot region and includes one or more courses also extending between the outer perimeter and the common portion. In one example, the heel portion can include a heel cushion or cushioning. In some aspects, radially-extending courses in a knitted component forming an upper can encircle at least a portion of a wearer's foot by extending between the common portion and around peripheries of one or more of the forefoot region, the midfoot region, and the heel region.

In one example, knitted components can include one or more knit courses formed starting from an outer perimeter of the knitted component and extending toward an inner perimeter of the knitted component, these courses being formed in a continuous process performed by a knitting machine. The courses that are formed can have different lengths, e.g., forming wedges, in one instance.

The radially-extending courses in the knitted components described herein may substantially align with a greater number of lines of containment than courses in conventionally knit articles, which can provide multi-directional containment and stability. As a result, an upper with radially-extending courses may allow a wearer to perform sharper turns and/or cuts with reduced slipping, sliding, or lateral displacement. Furthermore, aspects of the knitted components discussed herein may be utilized to add strength. For example, this can be provided through use of yarns having a high-tenacity, high stretch-resistance, and/or through use of particular knit structures that increase stretch-resistance along the lines of containment desired to improve performance for a particular activity or movement. In this way, an upper with radially-extending courses can provide stability and containment along different directions.

In some aspects, tensile elements can be incorporated into knitted components, e.g., as inlaid strands, e.g., to increase reinforcement and/or enhance containment. For example, a high-tenacity yarn, e.g., a polyester yarn, e.g., a non-elasticated polyester yarn, can be incorporated (e.g., inlaid or knitted) into the knitted components, uppers, and articles of footwear described herein to impart reinforcement in certain directions, e.g., along lines of containment. The tensile elements may each have the configuration of a multi-filament yarn, a filament (e.g., a mono-filament yarn), thread, rope, webbing, cable, or chain, for example. The tensile elements may comprise a material having a property to increase the strength of the knitted component in areas with the tensile elements. For example, the tensile elements may comprise a yarn having a high tenacity, such as a tenacity greater than 5 grams/denier. In some embodiments, the tenacity of the tensile elements may be greater than other yarn(s) of the knitted component. In one example, the tensile elements are formed from a high tenacity polyester yarn, such as Gral, produced by the Coats Group PLC. In another example, the tensile elements are formed by a high-tenacity nylon yarn. Further, in some examples, the tensile element may exhibit greater stretch-resistance than the rest of the knitted component and may be formed from a variety of engineering filaments that are utilized for high tensile strength applications, including glass, aramids (e.g., para-aramid and meta-aramid), ultra-high molecular weight polyethylene, and liquid crystal polymer.

In some aspects, knitted components may include a plurality of wedge portions that diverge radially from the common portion. In one example, the plurality of wedge portions are included in the forefoot region. Further, in some examples, the plurality of wedge portions are configured to form an arcuate shape at the forefoot region such that the plurality of wedge portions radially diverge from the common portion and extend around an outer periphery of the fore foot region.

In some aspects, knitted components may include a plurality of radially-diverging portions positioned about the common portion, where each of the plurality of radially-diverging portions include a plurality of courses.

In one example, radially-extending courses extend between the common portion and around a top of the forefoot region. For example, the radially-extending courses can diverge from the common portion and extend around the top of the forefoot region. As such, the one or more radially-extending courses in the forefoot region may be configured to substantially align with one or more lines of containment in the forefoot region, e.g., in a toe region. Thus, in one example, at least one radially-extending course substantially aligns with at least one containment line in the forefoot region, and/or toe region. The substantial alignment of the radially-extending courses with a plurality of lines of containment in the forefoot region can increase containment and stability in the forefoot region. Due to the improved stability and containment that can be provided by the radially-extending courses, an amount of added reinforcement can be reduced, which in turn improves breathability and enhances comfort.

In further aspects, knitted components herein may include one or more tensile elements, e.g., incorporated as inlaid strands. The inlaid strands may each form a plurality of strand segments that each extend at least partially between an outer perimeter and a common portion of a knitted component. The strand segments can remain connected and/or looped at the common portion and/or at the outer perimeter. Each inlaid strand may be formed of a material suitable for providing additional support, such as a strand having a greater thickness or weight, a greater amount of stretch-resistance, and/or a higher tenacity than a yarn that is interlooped together to form the rest of the knitted component. The one or more inlaid strands can thus be an additional, alternative, or distinct structure for providing containment along desired lines of containment. In different aspects, the inlaid strands that can be used to impart such properties can include engineering filaments that are utilized for high tensile strength applications, e.g., including glass, aramids (e.g., para-aramid and meta-aramid), ultra-high molecular weight polyethylene, liquid crystal polymer, and the like.

In some aspects, one or more of the density of the inlaid strand segments, the locations of the inlaid strand segments, the orientation of the inlaid strand segments, and the location of the common portion (which may impact the orientations and/or angles of the strand segments) may change based on a desired directionality and/or degree of containment. The degree of containment can be a resistance to stretching, elongation, and/or expansion along a radial direction extending from a common portion towards a perimeter or edge. In addition, the density, spacing, and/or number of inlaid strand segments can different across different parts of a knitted component and/or an upper that incorporates a knitted component to impart localized properties.

In additional aspects herein, a method of manufacturing a knitted component for an upper is provided. Creating radially-extending knit courses (and, in some aspects, inlaid strands) through the upper may be achieved through a knitting process that includes knitting at least a portion of one side of the upper (e.g., a lateral side or a medial side) before knitting any of the other side of the upper. For example, a first midfoot region, either on the lateral side or on the medial side, may be knit on a knitting machine. Then, a forefoot region may be knit on the knitting machine, followed by a second midfoot region on the other side of the upper (e.g., the opposite of either the lateral side or the medial side that was knit in the first midfoot region). In addition, the knitted component that is manufactured may include a combination of full-length knit courses and partial-length knit courses that together create the organic shape of a curved upper while maintaining the radial orientation of the knit courses.

For example, to generate a curved shape in the knitted component, e.g., a forefoot region of an upper, a plurality of "wedges" can be formed using a knitting machine. Each "wedge" is formed from a series of knitted courses formed on the knitting machine, in which the length of each knitted course is gradually increased in a series of sequentially knitted rows, and then the length is gradually decreased in another series of sequentially knitted rows, to form a wedge-like shape. The resulting "wedge" has a particular geometry that can be determined by the change in the length of the sequentially knitted rows and/or the change in the number of sequentially knitted rows. The result of creating "wedges" is that the knitted components can turn, e.g., defining a curved or arcuate geometry. For example, this can be used to form a curved forefoot region of an upper formed from the knitted component produced on the knitting machine.

In one aspect, a method of forming a knitted component for an upper comprises forming a knitted component with a plurality of wedges on a knitting machine, wherein the plurality of wedges form a forefoot region and/or a midfoot region. In one example of the method, a medial region or a lateral region is knitted on a knitting machine, and then subsequently a forefoot region is knitted on the knitting machine, such that it comprises a curved shape, and then subsequently the other of the medial region and the lateral region is knitted on the knitting machine.

In accordance with the disclosed knitting methods, the same feeder(s) used to form the lateral side of a knitted component can be used to form the medial side of a knitted component. In addition, at least a subset of needles used to form the lateral side can be used to form the medial side. The methods can further include integrating an inlaid strand by inlaying the strand within a course using a combination feeder. Inlaid strand segments on the lateral side may be formed with the same combination feeder that forms the inlaid strand segments on the medial side. Thus, a knitted component with radially extending courses and inlaid strands can be formed while also having a smaller footprint on the knitting machine compared to traditional processes for integrally knitting an upper. This can free up space and resources for simultaneously knitting another, separate article, such as a knitted component for a second upper.

As described, aspects of the present disclosure relate to articles of footwear or aspects thereof that are at least partially formed from knit textiles, or articles of apparel formed from such knit textiles. In one example, aspects are directed to an upper formed at least partially of a knitted component. As used herein, the term "upper" refers to a footwear component that extends over the instep and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, a walking shoe, or the like. Further, in other aspects, the upper may also be incorporated into a non-athletic shoe, such as a dress shoe, a loafer, and a sandal. Accordingly, the present aspects apply to a wide variety of footwear types. Although the figures may illustrate an article of footwear intended for use on only one foot (e.g., a right foot) of a wearer, unless indicated otherwise, one skilled in the art will recognize that a corresponding article of footwear for the other foot (e.g., a left foot) would be a mirror image of the right article of footwear.

Positional terms used to describe articles of footwear or aspects thereof, such as top, bottom, front, sides, back, superior, inferior, lateral, medial, right, left, interior, exterior, inner-facing, and outer-facing and the like, are used with respect to the article of footwear or upper being worn as intended with the wearer standing upright such that the wearer's foot is in the foot-receiving void and the wearer's ankle or leg extends through the ankle opening. For example, an "upwardly-facing surface" and/or an "upper surface" of an upper refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article extending between the heel region and the forefoot region. Similarly, a "longitudinal length" refers to a length of the article along the longitudinal axis, and a "longitudinal direction" refers to a direction along the longitudinal axis. It should be understood, however, that use of positional terms do not depend on the actual presence of a human being for interpretative purposes.

The terms "knitted component" and "knit element" refer to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as it is knit on the knitting machine) that is produced by adjacent needles during the same knitting cycle. The course may comprise one or more stitch types, such as a knit stitch, a missed stitch, a tuck stitch, a transfer stitch, a rib stitch, and the like as these terms are known in the art of knitting. The term "wale," as used herein, is a predominantly vertical column of intermeshed or interlooped knit loops, generally produced by the same needle at successive (but not necessarily all) courses or knitting cycles.

The term "integrally knit," as used herein, may mean a knitted component that has a yarn of one or more knitted courses in a first area or region interlooped with one or more knitted courses of another area or region. The interlooping may be through a simple knit stitch, a tuck stitch, a held stitch, a float stitch, a miss stitch, or the like. In this way, areas that are integrally knit together can have a seamless transition.

The term "inlaid strand," as used herein, may refer to an elongated piece of material, such as a yarn, cable, filament, mono-filament, multi-filament, and/or fiber, or any combination thereof, that extends through a course formed by one or more other strands forming loops. The inlaid strand may include a loop at each end to anchor the strand into the knitted element but may generally otherwise extend through a course without being interlooped with another strand. In one example, an inlaid strand may be interlooped with loops of another strand forming a course.

The term "radially extending," as used herein, refers to an orientation of an elongate structure, such as a knit course and/or an inlaid strand segment and/or a wedge portion, that radiates out from a common portion of the knitted component. Specifically, the knit course and/or the inlaid strand may be radially extending if extending at least partially between a common portion and an outer perimeter of the knitted component. In this manner, the courses and/or strand segments may radiate outward from the common portion toward the outer perimeter rather than, for example, extend continuously across the body of the knitted component from a lateral side edge to a medial side edge of the outer perimeter (although, in aspects contemplated herein, such configurations may be present in combination with a radial knit structure forming an upper). In addition, structures of the knitted component may be radially extending from the common portion when the knitted component is laid out in a flat configuration after knitting, but it is also contemplated that determining whether structures are radially extending may be based on the orientation of the structures towards the common portion after the knitted component is folded into the shape of an upper or a portion of an upper.

The term "common portion," as used herein, refers to an area of the knitted component towards which and/or away from which multiple similar structures (e.g., multiple courses or multiple inlaid strand segments) extend. With this configuration, courses or inlaid strand segments may extend from an outer perimeter of the knitted component to a single common portion of the knitted component rather than extending from the outer perimeter to different portions. The common portion is spaced apart from the outer perimeter and, in various aspects, may be relatively centrally located within the knitted component. In this way, the common portion may encompass or be directly adjacent the longitudinal axis of the knitted component. In some examples disclosed herein, the common portion may include or be a throat region or a portion thereof.

As used herein, the term "throat region" refers to an area on a top (upward-facing) side of an upper generally extending between an ankle opening and a forefoot region. The throat region may include an opening formed between a lateral side and a medial side of the upper when formed into the shape of the article of footwear, and in some aspects, the throat region may include a tongue extending across the opening in the throat region. In some aspects, the throat region does not have an opening but, rather, includes a continuous integrally knit area of a knit component extending between the medial and lateral sides.

As used herein, the term "perimeter" refers to an area forming the boundary of the object referred to. For example, a perimeter of a knitted component is the area that extends along the boundary of that structure. The "outer perimeter" may refer to portions of a perimeter of a knitted component that, once formed into an article of footwear, form the biteline between an upper and a sole structure, and/or a seam between two ends of the outer perimeter. In contrast, an "inner perimeter" may refer to portions of the perimeter of a knitted component that, once formed into an article of footwear, define openings, such as an opening in a throat region and/or an ankle opening. The perimeter (outer perimeter or inner perimeter) may refer to an edge of the knitted component or to a peripheral area adjacent the edge.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional assembly. Additionally, there are various measurements provided herein throughout. Unless indicated otherwise, the terms "about," "approximately," or "substantially" with respect to a measurement means within ±10% of the indicated value. For example, a value can be a length, angle, radial direction, linear direction, or unit of measurement, among other things.

Figure 2:
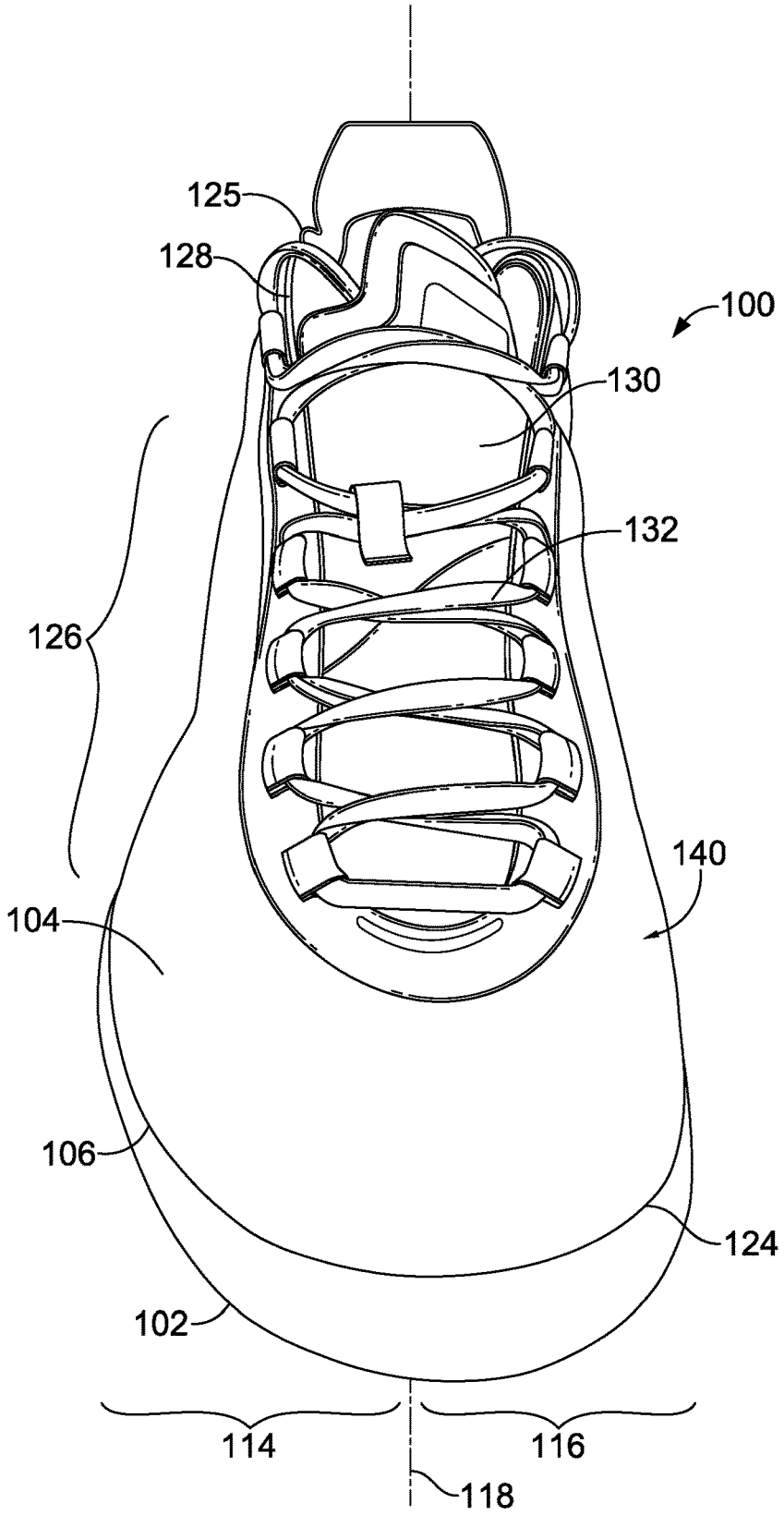
FIG. 2 depicts a front perspective view of the article of footwear shown in FIG. 1, in accordance with aspects hereof.

FIGS. 1 and 2 depict a side view and a front perspective view, respectively, of an article of footwear 100 and its components, according to one aspect hereof. The article of footwear 100 comprises a sole structure 102 and an upper 104. The upper 104 is coupled to, and extends from, the sole structure 102 and forms a foot-receiving cavity between the sole structure 102 and the upper 104. The area of the article of footwear 100 where the sole structure 102 joins the upper 104 may be referred to as the biteline 106. The upper 104 may be joined to the sole structure 102 in a fixed manner using any suitable technique, e.g., through the use of an adhesive, through sewing, through welding, or the like. It is contemplated that the upper 104 may extend partially or completely around the foot of a wearer, may extend under the foot of a wearer, and/or may be integral with the sole. In addition, a sockliner, which may be referred to as a strobel, may or may not be used. The sockliner can comprise various materials including textile, leather, foam, and/or other types of materials. In additional aspects, a heel counter may also be used in the articles of footwear.

The article of footwear 100 (and/or components thereof) can be divided into one or more regions (which may also be referred to as "areas," or "portions"). For example, in an anterior-to-posterior direction, the article of footwear 100 (and/or components thereof) can be divided into (and/or include) a forefoot region 108, a midfoot region 110, and a heel region 112. The forefoot region 108 of the article of footwear 100 can correspond to anterior portions of a foot, including toes and joints connecting metatarsal bones with phalanx bones of the foot. The midfoot region 110 of the article of footwear 100 can correspond with an arch area of the foot. The heel region 112 of the article of footwear 100 can correspond with posterior portions of the foot, including a calcaneus bone. In a medial-to-lateral direction, the article of footwear 100 (and/or components thereof) can be divided into a lateral side 114 and a medial side 116, both of which extend through the forefoot region 108, the midfoot region 110, and the heel region 112. More particularly, the lateral side 114 corresponds with an outside area of the foot (i.e., the side that faces away from the other foot) when the article of footwear 100 is worn, while the medial side 116 corresponds with an inside area of the foot (i.e., the side that faces towards the other foot) when the article of footwear 100 is worn. The lateral side 114 and the medial side 116 are separated by a longitudinal axis 118. These regions 108, 110, and 112 and sides 114 and 116 are not intended to demarcate precise areas of the article of footwear 100, but rather are intended to represent general areas of the article of footwear 100 to aid in understanding the various descriptions provided herein.

The sole structure 102 generally extends between the foot and the ground when the article of footwear 100 is worn. The sole structure 102 may include multiple components, such as an outsole, a midsole, and an insole or sockliner. Various materials may be used to form the sole structure 102, such as rubber, ethylene vinyl acetate (EVA), thermoplastic polyurethane (TPU), thermoplastic elastomer (e.g., polyether block amide), or similar suitable materials. The sole structure 102 may also include various other elements, such as a heel counter and a toe cap. The sole structure 102 may include various other features to attenuate forces, enhance stability, and/or provide traction, such as treads as understood by one skilled in the art.

The upper 104 defines a void within the article of footwear 100 for receiving and securing a foot relative to the sole structure 102. Access to the void is provided by an ankle opening 125 located in at least the heel region 112. The ankle opening is defined by an ankle collar 128. The upper 104 also includes a throat region 126 disposed in the midfoot region 110 between the ankle opening 125 and the forefoot region 108. The throat region 126 may be configured to cover a top side of the wearer's foot, and therefore form part of a top side (or overfoot region) of the upper 104 between the lateral side 114 and the medial side 116. The article of footwear 100 can also include a closure system in the throat region 126 to adjust the foot-receiving cavity. In this manner, the closure system can be used, for example, to secure and/or release the article of footwear 100 to and/or from a wearer's foot. Example closure systems include laces 132 (e.g., as shown in FIGS. 1 and 2), straps, bands, cables, cords, ratcheting mechanisms, hook-and-loop, and the like.

Looking still at FIGS. 1 and 2, at least a portion of the upper 104 may be formed of at least one knitted component 140, such as by a weft-knitting process on a flat knitting machine, for example. In some aspects, the entire or substantially the entire upper 104 may be formed of the knitted component 140. The knitted component 140 may incorporate various types of yarn(s) that impart different properties to separate areas of the upper 104. That is, one area of the knitted component 140 may be formed from a first type of yarn that imparts a first or first set of properties, and another area of the knitted component 140 may be formed from a second type of yarn that imparts a second or second set of properties. With this configuration, properties may vary throughout the upper 104 by selecting specific yarns for different areas of the knitted component 140. The properties that a particular type of yarn will impart to an area of the knitted component 140 partially depend upon the materials that form the various filaments and fibers of the yarn. Cotton, for example, can provide a soft hand, natural aesthetics, and biodegradability. Elastane and stretch polyester can each provide substantial stretch and recovery, while stretch polyester can provide recyclability. Rayon can provide high luster and moisture absorption. Wool can also provide high moisture absorption in addition to insulating properties and biodegradability. Nylon is a durable and abrasion-resistant material with a relatively high strength. Polyester is a hydrophobic material that also provides relatively high durability. In addition to materials, other aspects of the yarns selected for the knitted component 140 may affect the properties of the upper 104. For example, a yarn forming the knitted component 140 may be a monofilament yarn or a multi-filament yarn. The yarn can also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of the upper 104. Accordingly, both the materials forming the yarn and other aspects of the yarn may be selected to impart a variety of properties to separate areas of the upper 104. The yarns may be selected based on different properties, e.g., tensile strength, tenacity, elasticity, cushioning, or the like, in accordance with different aspects contemplated herein.

The knitted component 140 may be formed as a single integral one-piece element during a knitting process, such as a weft-knitting process, or another knitting process. Additional elements, such as an underfoot portion and/or a heel element (including, but not limited to a heel cushion, a heel counter, or other elements or components) may be integrally formed with the upper 104 as a one-piece unitary structure. Alternatively, one or more such additional elements may be formed separately from the upper 104 and then can later be attached, secured, or otherwise assembled as necessary. Forming the upper 104 with the knitted component may provide the upper 104 with advantageous characteristics including, but not limited to, a particular degree of elasticity, breathability, bendability, strength, moisture absorption, weight, abrasion resistance, and/or a combination thereof. Further, forming the upper 104 from an integrally knit knitted component may form various features and structures of the upper 104 without the need for significant additional manufacturing steps or processes, thereby increasing production efficiency.

The knitted component 140 may include one or more radially-extending courses. That is, the knitted component 140 may include knit courses that extend between an outer perimeter of the knitted component 140 (which may form or be adjacent to the biteline 106 when the knitted component 140 is formed into the upper 104 and joined to the sole structure 102) and a common portion of the knitted component 140. The common portion may be an area of the knitted component 140 that some or substantially all courses extend towards when the knitted component 140 is formed into the shape of the upper 104. In some aspects, the common portion is along or includes a portion of the longitudinal axis 118. In some aspects, the common portion is adjacent to the longitudinal axis 118. For example, the common portion may include the throat region 126, which extends along the longitudinal axis 118. As further described with respect to FIG. 3, radially-extending courses within the knitted component 140 may create courses that align with many different lines of containment such that the knit courses can at least partially provide containment around the wearer's entire foot or portions thereof.

Figure 3:
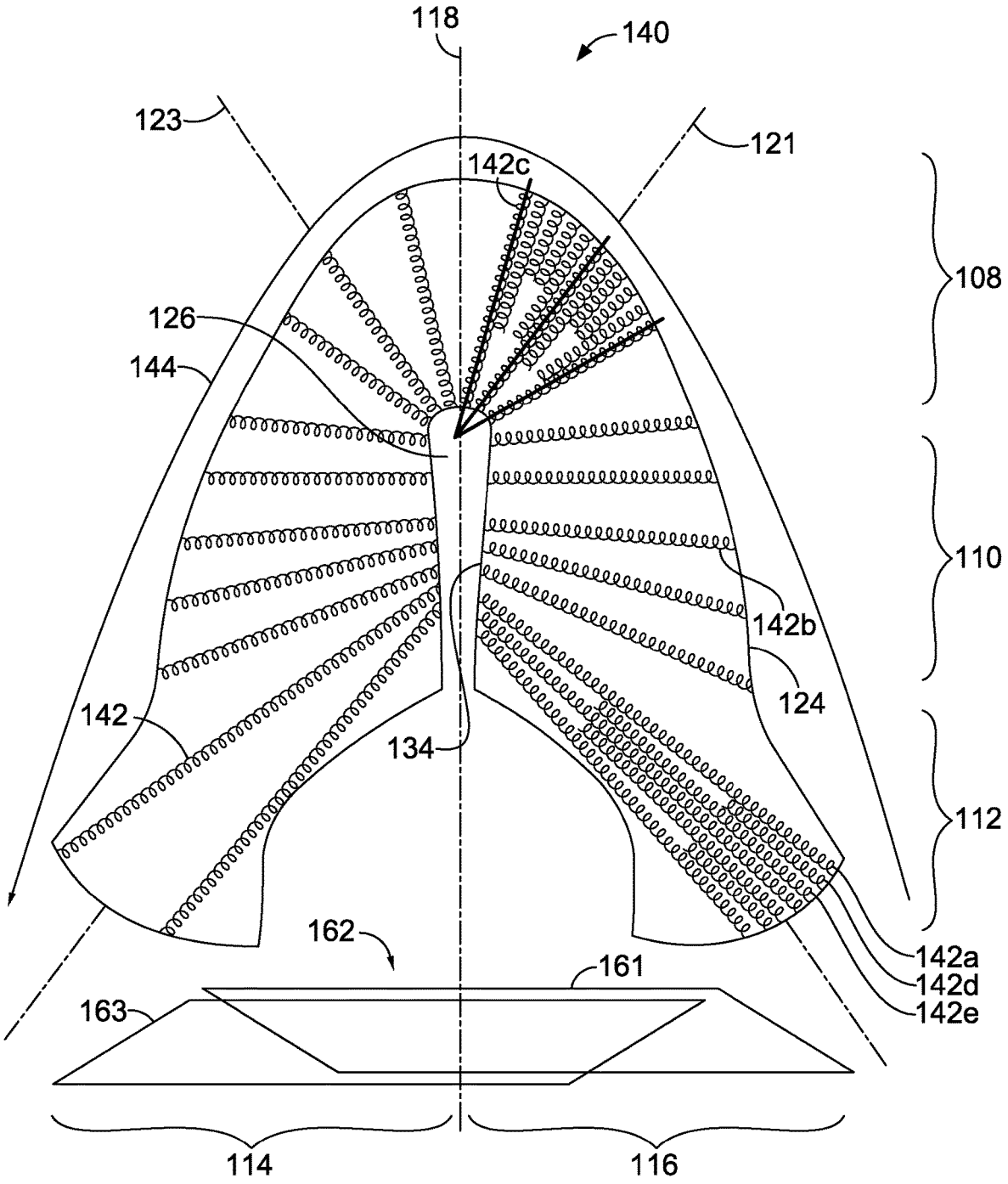
FIG. 3 depicts a schematic view of an example knitted component for the example article of footwear shown in FIG. 1, in accordance with aspects hereof.

FIG. 3 depicts a schematic view of the knitted component 140 with radially-extending courses, such as courses 142*a*-142*e*, which may collectively be referred to as "courses 142." The courses 142 are each depicted as having a strand of knitted loops in a simplified form, and it should be understood that these strands of loops do not necessarily represent the stitch sequence used. For example, the courses 142 may include other types of stitches, such as float stitches, tuck stitches, transfer stitches, and the like. Similarly, only some courses are depicted throughout the knitted component 140 as representative of the various directions in which the courses 142 may extend (for clarity), and thus it should be understood that there may be additional courses located between the courses 142 depicted in FIG. 3 that radially extend from a common portion of the knitted component 140 in a similar manner as described below and shown in FIG. 3. In addition, the courses 142 depicted in FIG. 3 can also be interconnected such that the courses 142 transition between each other at the common portion and/or at the outer perimeter, rather than being distinct.

The courses 142 extend from an outer perimeter 124 to a common portion or region. In the example of FIG. 3, the common portion is the throat region 126, which may include a tongue component (such as the tongue 130 in FIGS. 1 and 2), an opening for a tongue component, and/or an inner perimeter 134 of the knitted component defining a space through which a tongue component may extend. In some aspects, the throat region 126 is knit continuously from the lateral side 114 to the medial side 116 such that there may not be an opening or space for a tongue component.

The forefoot region 108, the midfoot region 110, and the heel region 112 may each include radially-extending courses that extend in different directions such that at least some of the courses are not parallel to one another. For example, at least a forefoot course in the forefoot region 108, such as course 142*c*, extends in a direction that is not parallel to a midfoot course in the midfoot region 110, such as course 142*b*. In other words, at least some courses, including forefoot course 142*c* and the midfoot course 142*d*, may be angled relative to each other, where the angle is greater than 0 degrees and less than 180 degrees.

Thus, the courses 142 may extend in different directions which may represent different lines or angle of potential containment. In some aspects, the various directions that the courses extend may be effectively 360 degrees around the center of the wearer's foot. These lines of containment may represent where a foot may be contained, which may be accomplished through various knit structures. In some aspects, greater containment is achieved by utilizing yarns of higher tensile strength and/or higher stretch-resistance for courses along certain lines of containment, utilizing certain knit stitches, such as floats, for reducing stretch in courses along certain lines of containment, or a combination thereof.

In example aspects, the knitted component 140 includes courses that are aligned, e.g., parallel or substantially parallel, with a first diagonal line of containment (shown by a first axis 121) and includes courses that are aligned, e.g., parallel or substantially parallel, with a second diagonal line of containment (shown by a second axis 123) that intersects with the first line of containment in the common portion of the knitted component 140. The first axis 121 may extend from a portion of the knitted component 140 configured to cover a first metatarsal of the wearer to the heel region 112 on the lateral side 114, and the second axis 123 may extend from a portion of the knitted component 140 configured to cover a fifth metatarsal of the wearer to the heel region 112 on the medial side 116. These axes 121 and 123 may collectively form an x-shape and may represent lines of containment that may improve the stability of a wearer's foot within an upper for many types of movements (including turning or changing the direction of movement, side-to-side movements, forward movements, and backward movements). As such, containing the wearer's foot within the upper 104 through courses limiting stretch or otherwise providing support along these axes 121 and 123 may enhance performance of the article of footwear 100.

The knitted component 140 with radially-extending courses 142 may be created through a radial knit process in which the lateral and medial sides 114, 116 of the knitted component 140 are formed sequentially, as opposed to simultaneously. As shown in FIG. 3, the knitted component 140 is formed by a knitting machine 162 by starting at the heel region 112 on the medial side 116 of the knitted component 140, knitting in a knit direction 144 from the heel region 112 to the forefoot region 108, and then knitting the lateral side 114 of the knitted component 140 starting at the forefoot region 108 and finishing at the heel region 112 on the lateral side 114, as shown by knit direction 144. In this way, the knitted component 140 may be formed by knitting the medial side 116 (or at least a plurality of courses on the medial side 116), knitting the forefoot region 108 after knitting the courses on the medial side 116, and knitting the lateral side 114 (or at least a plurality of courses on the lateral side 114) after knitting the forefoot region 108.

In other aspects, a similar but opposite knitting direction may be utilized to form the knitted component 140. For example, the knitted component 140 may be formed by knitting the lateral side 114 (or at least a plurality of courses on the lateral side 114), knitting the forefoot region 108 after knitting the courses on the lateral side 114, and knitting the medial side 116 (or at least a plurality of courses on the medial side 116) after knitting the forefoot region 108.

This process for making the knitted component 140 may be performed on a knitting machine 162, which may be an automated knitting machine. In example aspects, the knitting machine 162 includes a front needle bed 161 and a back needle bed 163 shown in FIG. 3 and similarly shown in FIG. 4 (e.g., with knitting machine 462 with needle beds 461, 463), each being depicted as a simplified representation. Accordingly, in example aspects, the knitting machine (and the others depicted herein) may be a flat knitting machine, such as a flat V-bed knitting machine with a front needle bed 161 and a back needle bed 163. In various aspects, the knitted component 140 may be formed by needles from a single needle bed or by needles from both needle beds.

In accordance with this knit process in which the lateral and medial sides 114, 116 are formed sequentially, at least some of the needles utilized to form the lateral side 114 are also utilized to form the medial side 116. In this way, a smaller number of needles on a knitting bed of the knitting machine 162 may be required to create the knitted component 140 compared to a traditional knitting process in which heel and/or midfoot portions of the lateral and medial sides 114, 116 are formed at the same time. Additionally, the same feeder(s) may be utilized for the yarn forming for both the lateral and the medial sides 114, 116, rather than requiring duplicate feeders for each side. In this fashion, the disclosed knitting process can make more needles and/or feeders on the knitting machine 162 available to knit a separate article, such as another knitted component for another upper, at the same time that the knitted component 140 is being knit.

Further, as shown in FIG. 3, forming the knitted component 140 to have radially-extending courses 142 includes forming full-length and partial-length knit courses. A full-length knit course, such as course 142*a*, may extend from one edge of the knitted component 140 (e.g., at the outer perimeter 124) to another edge of the knitted component 140 (e.g., at the inner perimeter 134 in the throat region 126). A partial-length knit course, such as courses 142*d* and 142*e*, may not extend between two edges of the knitted component 140. One or both ends of a partial-length knit course may end before the edge of the knitted component 140 is reached. However, the partial-length knit courses, such as courses 142*d* and 142*e* may still be considered radially-extending as they extend in a direction from the outer perimeter 124 towards the common portion (e.g., the throat region 126). Forming partial-length knit courses distributed between full-length knit courses may create shape and dimension in the knitted component 140 while also enabling the courses to extend radially.

Figure 4:
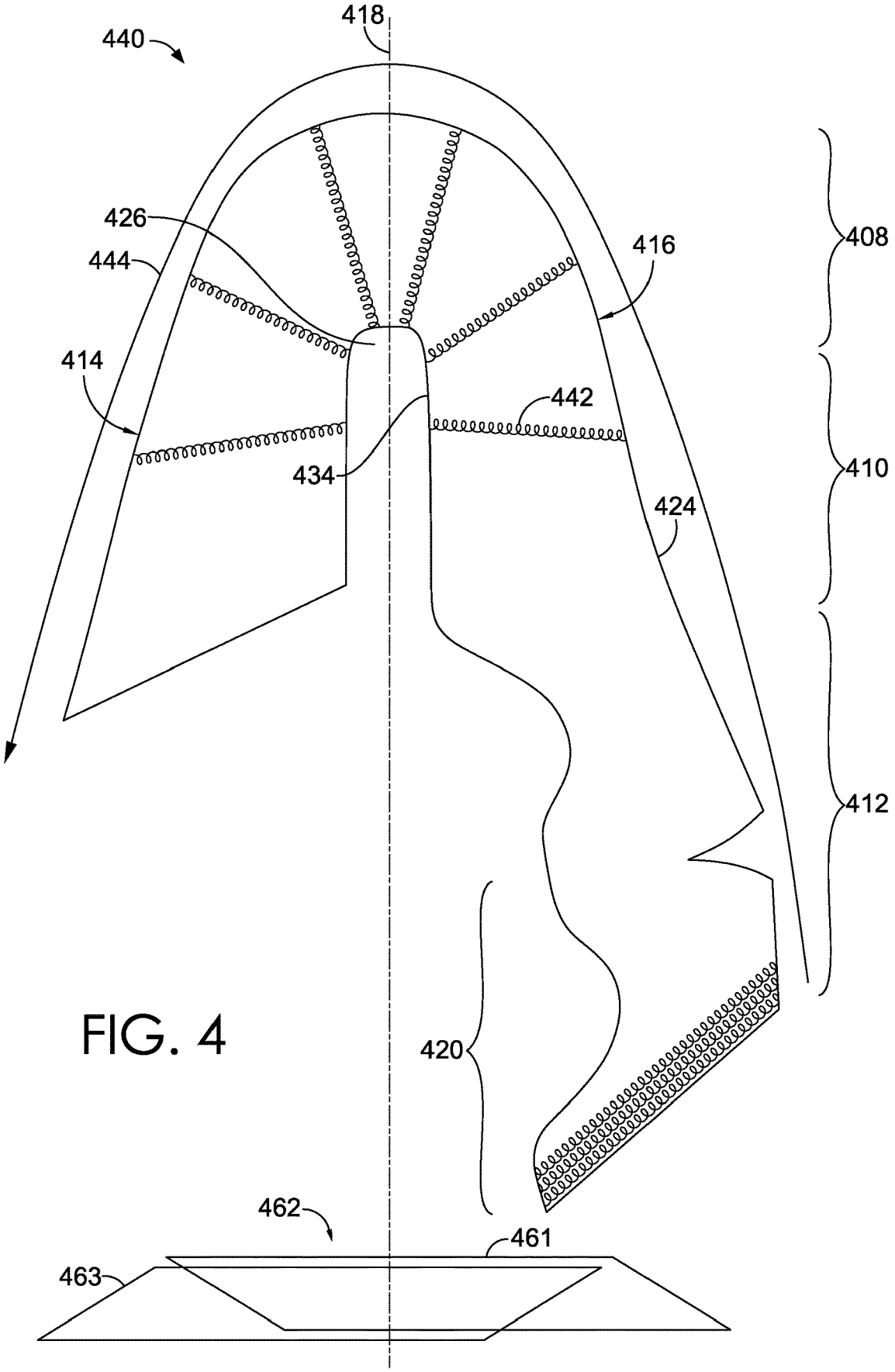
FIG. 4 depicts a schematic view of another example knitted component for the example article of footwear shown in FIG. 1, in accordance with aspects hereof.

FIG. 4 depicts another example knitted component 440, which may form an upper for an article of footwear, such as the upper 104 for the article of footwear 100 shown in FIGS. 1 and 2. Except as otherwise stated or depicted in FIG. 4, any features of the knitted component 140 shown in FIGS. 1-3 may apply to the knitted component 440 and any features of the upper 104 and the article of footwear 100 may apply to an upper and article of footwear in which the knitted component 440 is incorporated.

In FIG. 3, an entire side (e.g., the medial side 116) may be knit before knitting the other side (e.g., the lateral side 114). However, in other aspects, such as shown in FIG. 4, the areas of a knitted component in which the knitting processes starts and stops may vary. In FIG. 4, for example, the knit direction 444 still generally takes on an arched or arcuate shape, similar to the knit direction 144, but the knit direction 444 begins in an area of the heel region 412 of one side and ends in an adjacent region (e.g., the midfoot region 410) on the same side. As such, an area 420 in which knitting may begin (or end if the knit direction 444 is reversed) may form the heel region 412 on the lateral side 414 after edges of the knitted component 440 are joined to form an upper. Nevertheless, the sequential manner described with respect to FIG. 3 may be maintained in this configuration as the lateral and medial sides 414, 416 are not knit simultaneously. Instead, the sequence of knitting may proceed as follows: the area 420 of the heel region 412 later positioned on the lateral side 414 is knit, then the rest of the heel region 412 that forms the medial side 416 is knit, then the midfoot region 410 on the medial side 416 is knit, then the forefoot region 408 is knit, and then the midfoot region 410 on the lateral side 414 is knit. Therefore, an upper formed by the knitted component 440 may have a seam on the lateral side 414 instead of in the center of the heel region 412.

The knitted component 440 may still have radially extending courses 442 extending from an outer perimeter towards a common portion of the knitted component 440, which may be a throat region 426 defined by an inner perimeter 434. The radial orientation of the courses may be based on the knitted component 440 after it is formed into an upper, such as the upper 104 of FIGS. 1 and 2. That is, regardless of where the knitting process starts, courses may extend between the outer perimeter 424 and the common portion (e.g., from the outer perimeter 424 to the common portion). When the knitted component 440 is laid out flat after the knitting process, there may be courses that do not extend towards the common portion, such as some courses in the area 420. However, once the knitted component 440 is formed into the shape of an upper by joining the area 420 to the rest of the lateral side 414, courses in the area 420 may be oriented such that they do extend from the outer perimeter 424 to the common portion (e.g., the throat region 426).

Figure 5:
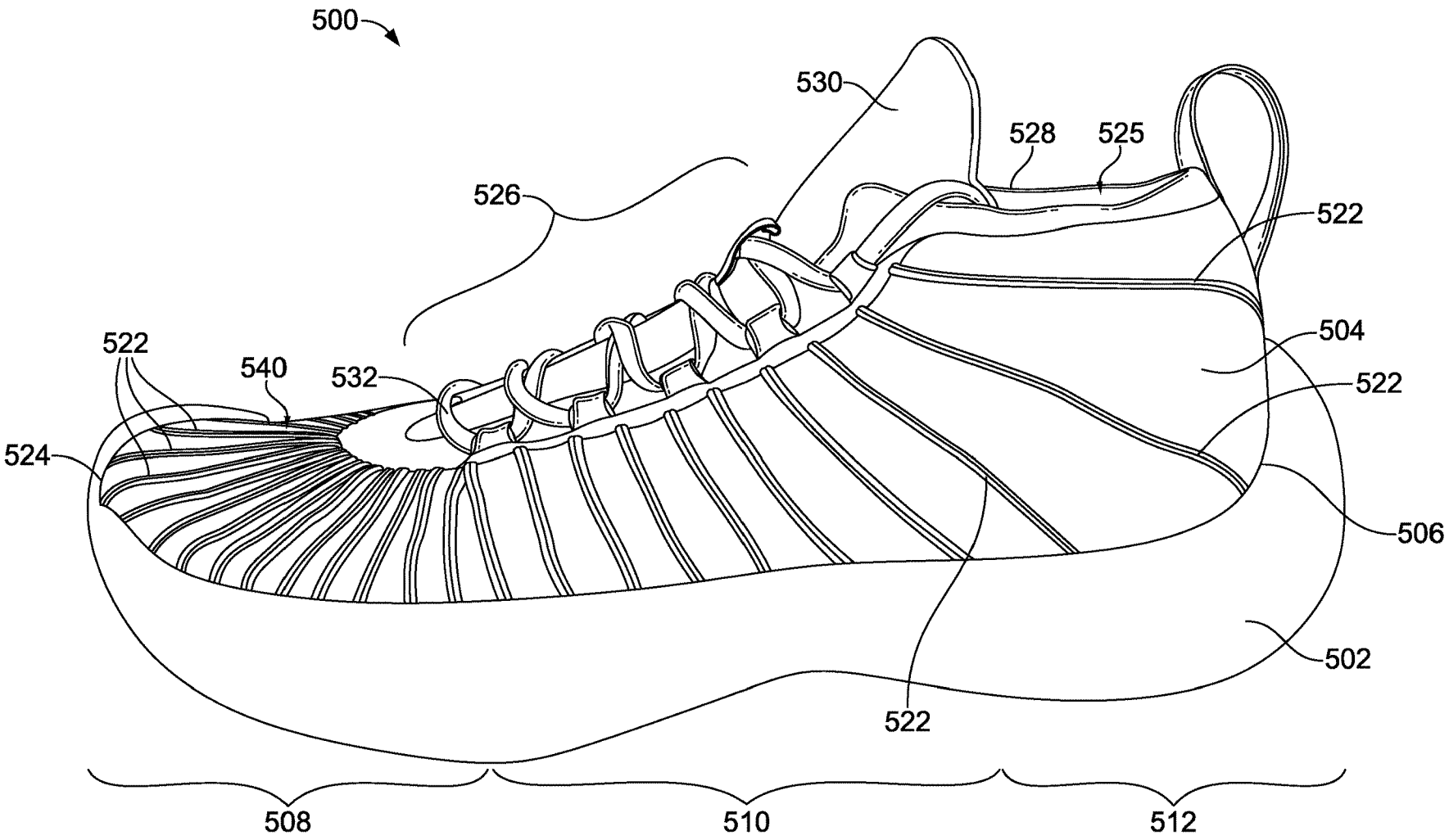
FIG. 5 depicts a side view of an example article of footwear formed with a knitted component having an inlaid strand, in accordance with aspects hereof.
Figure 6:
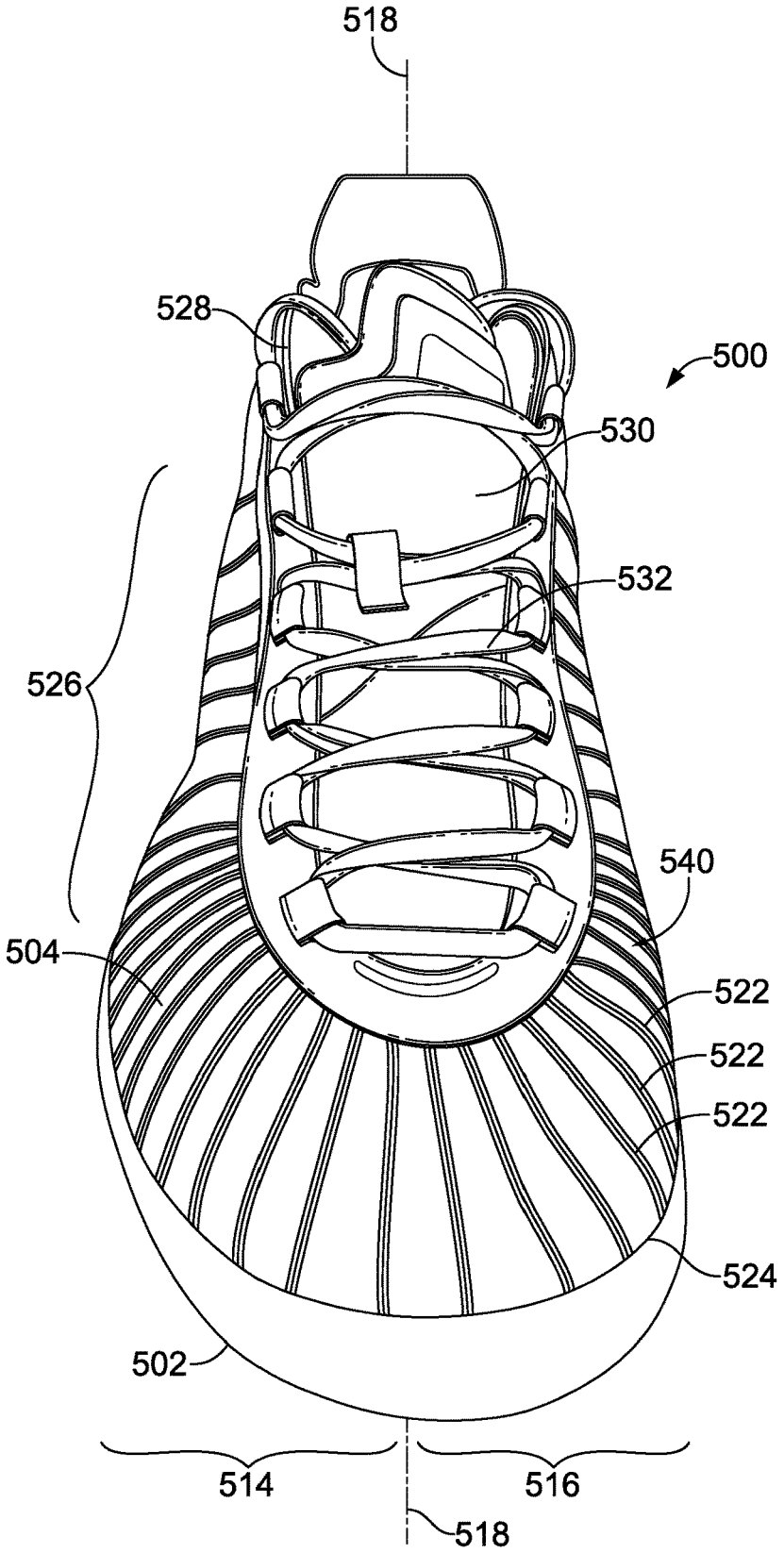
FIG. 6 depicts a front perspective view of the example article of footwear shown in FIG. 5, in accordance with aspects hereof.

FIGS. 5 and 6 depict a side view and a front perspective view, respectively, of an article of footwear 500 and its components, according to aspects hereof. Except where otherwise indicated, the article of footwear 500 may include any of the features described with respect to the article of footwear 100 shown in FIGS. 1 and 2. As such, the article of footwear 500 comprises a sole structure 502 and an upper 504 that is coupled to the sole structure 502 and forms a foot-receiving cavity.

The upper 504 defines a void within the article of footwear 500 for receiving and securing a foot relative to the sole structure 502. Access to the void is provided by an ankle opening 525 located in at least a heel region 512. The upper 504 may also include a throat region 526 disposed in the midfoot region 510 between the ankle opening 525 and a forefoot region 508. The throat region 526 may be configured to cover a top side of the wearer's foot and, therefore, form part of a top side (or overfoot region) of the upper 504 between a lateral side 514 and the medial side 516. In the depicted aspect, the throat region also includes a tongue portion, e.g., the tongue portion 530. The article of footwear 500 can also include a closure system, such as laces 532, in the throat region 526 to adjust the foot-receiving cavity.

At least a portion of the upper 504 may be formed of at least one knitted component 540, which may be formed as a single integral one-piece element during a knitting process.

Unless otherwise indicated, the knitted component 540 shown in FIG. 5 may have any of the features described with respect to the knitted component 140 shown in FIGS. 1-3. As such, the knitted component 540 may form the forefoot region 508 and the midfoot region 510. In further embodiments, the knitted component 540 also forms the heel region 512. In this example, the regions 508, 510, and 512 may be integrally knitted together, e.g., in a single knitting process. In addition, the knitted component 540 may have radially extending knit courses that extend from an outer perimeter 524 of the knitted component 540 to a common portion of the knitted component 540. The common portion may include at least part of the throat region 526, which may extend along a longitudinal axis 518 of the knitted component 540.

Figure 7:
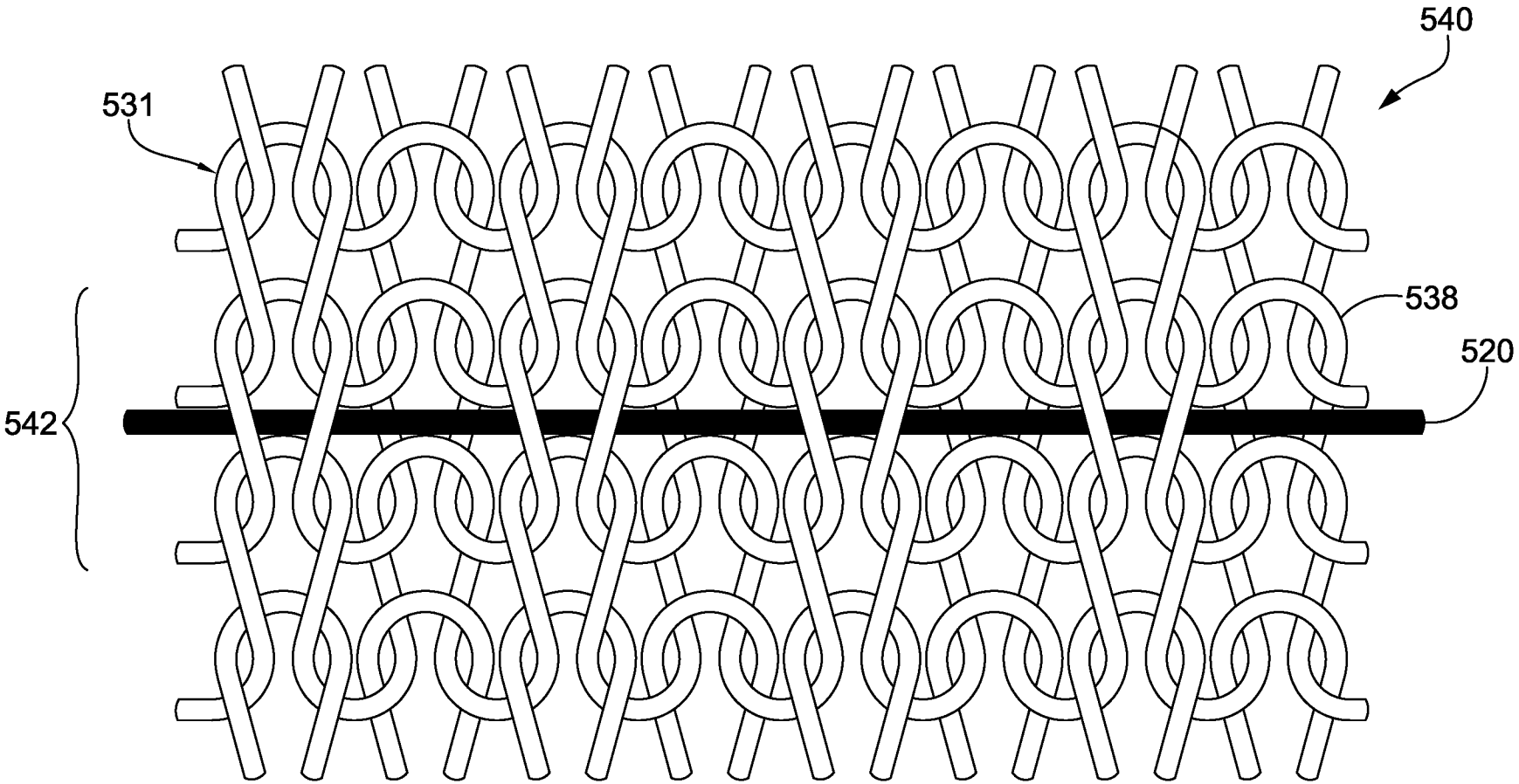
FIG. 7 depicts a schematic close-up view of an inlaid strand incorporated into an example knitted component, in accordance with aspects hereof.

The knitted component 540 may also include one or more inlaid strands that define a plurality of strand segments 522. An inlaid strand passes between various loops of a base knit element, which may be referred to herein as a knit element. FIG. 7 depicts an enlarged schematic of the knitted component 540 with an inlaid strand 520. Specifically, the knitted component 540 includes a knit element 531 and the inlaid strand 520. The knit element 531 includes courses, such as a course 542, formed from intermeshed loops of one or more yarns, such as yarn 538, and the inlaid strand 520 extends through one or more knit courses of the knit element 531 by passing between various loops within the knit element 531.

The knit element 531 may incorporate various types of yarn(s) that impart different properties to areas of the upper 504 as previously described with respect to the knitted component 140 of FIGS. 1-3. Further, as with the yarn(s) forming the knit element 531, the configuration of the inlaid strand 520 may also vary significantly. The inlaid strand 520 may be a yarn, or may have the configurations of a filament (e.g., a mono-filament), thread, rope, webbing, cable, or chain, for example.

In comparison with the yarns forming the knit element 531, the thickness of the inlaid strand 520 may be greater. In some configurations, the inlaid strand 520 may have a significantly greater thickness than the yarn(s) of the knit element 531, e.g., having a width at least 25%, at least 50%, at least 75%, or at least 100% greater than a width of the yarn(s) of the knit element 531. The cross-sectional shape of the inlaid strand 520 can be round, but it can also be triangular, square, rectangular, elliptical, or irregular in shape in different aspects. Moreover, the materials forming the inlaid strand 520 can include any of the materials for the yarn within the knit element 531, such as cotton, elastane, polyester, rayon, wool, and/or nylon. As noted above, the inlaid strand 520 may exhibit greater stretch-resistance than the knit element 531 and/or yarn(s) thereof. As such, suitable materials for inlaid strands 520 may include a variety of engineering filaments that are utilized for high tensile strength applications, including glass, aramids (e.g., para-aramid and meta-aramid), ultra-high molecular weight polyethylene, and liquid crystal polymer, among others. As another example, a braided polyester thread may also be utilized as inlaid strand 520. The inlaid strand can also have a higher-tenacity and/or tensile strength that yarn(s) of the knit element 531, measured the using the same test under the same conditions, e.g., such as ASTM D3822.

As stated, the inlaid strand 520 is located within the knit structure of the knit element 531, which may have the configuration of a single textile layer in the area of inlaid strand 520, and between inner-facing and exterior-facing surfaces. When the knitted component 540 is incorporated into the article of footwear 500, the inlaid strand 520 is therefore located between the exterior surface and the interior surface of the upper 504. Specifically, and as shown in FIG. 7, the knit element 531 includes a yarn 538 that forms a plurality of intermeshed loops defining multiple courses and wales. The inlaid strand 520 extends along one of the courses, such as course 542, and alternates between being located (a) behind loops formed by the yarn 538 and (b) in front of loops formed by the yarn 538. In effect, the inlaid strand 520 extends through the structure formed by the knit element 531. While the yarn 538 forms each of the courses in this configuration, additional yarns may form one or more of the courses or may form a portion of one or more of the courses. In some aspects, the knitted component 540 includes a double-knit textile construction formed with yarns that switch between needles on two needle beds. An inlaid strand, similar to the inlaid strand 520, may extend generally between the surfaces formed by loops on the two beds. In some aspects, segments of the inlaid strand 520 may extend behind and/or in front of loops formed on both beds.

The inlaid strand 520 in FIG. 7 may represent at least part of a strand segment 522 depicted in FIGS. 5 and 6. Each strand segment 522 extends along a course in the knit element 531 that forms the knitted component 540 and, as such, extends radially between the outer perimeter 524 of the knitted component 540 and the common portion, which may be the throat region 526. Similar to knit courses described with respect to the knitted component 140, the strand segments 522 may extend from the outer perimeter 524 to the common portion in various directions across the forefoot region 508, the midfoot region 510, and/or the heel region 512, e.g., in different aspects being located in any one or combination of these regions. In this manner, the inlaid strand 520 forms a plurality of strand segments 522 that radially fan-out from a common portion (e.g., the throat region 526 or a delineation thereof as shown in FIG. 6). In addition, with this configuration, one or more inlaid strand segments may be substantially aligned with lines of containment associated with the knitted component 540.

Figure 8:
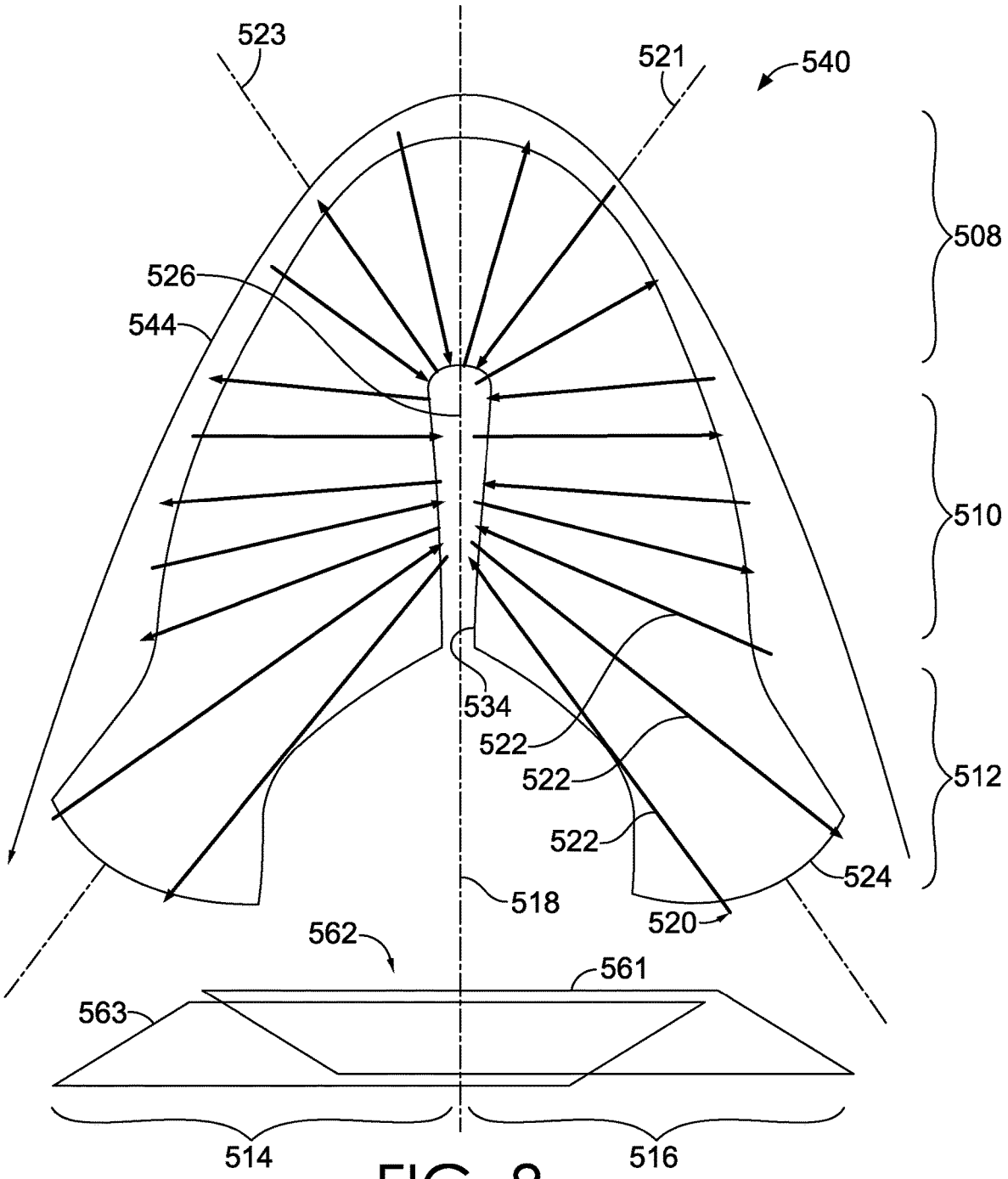
FIG. 8 depicts a schematic view of an example knitted component with an inlaid strand, in accordance with aspects hereof.

FIG. 8 depicts a schematic view of the knitted component 540 having radially-extending inlaid strand segments 522. It should be noted that courses of knitted loops are omitted in FIG. 8 to simplify the drawing but it should be understood that the knitted component 540 depicted in FIG. 8 may include radially extended courses of knitted loops similar to the courses 142 described with respect to FIG. 3. The courses may be generally continuously arranged radially, and may include an inlaid strand segment 522, while other courses may not include an inlaid strand segment 522.

As the inlaid strand segments 522 may impart stretch-resistant properties to areas in which they are located, incorporating inlaid strand segments 522 to extend along various lines of containment may further increase the ability to contain the foot within the upper 504 beyond containment provided from the knit courses.

In example aspects, the knitted component 540 includes inlaid strand segments 522 that are aligned, e.g., parallel or substantially parallel (e.g., being at a small angle of deviation from parallel), with a first diagonal line of containment (shown by a first axis 521) and courses that are aligned, e.g., parallel or substantially parallel (e.g., being at a small angle of deviation from parallel), with a second diagonal line of containment (shown by a second axis 523) that intersects with the first diagonal line of containment in the common portion of the knitted component 540. This alignment can be greater than that provided with convention knit processes. The first axis 521 may extend from a portion of the knitted component 540 configured to cover a first metatarsal of the wearer to the heel region 512 on the lateral side 514, and the second axis 523 may extend from a portion of the knitted component 540 configured to cover a fifth metatarsal of the wearer to the heel region 512 on the medial side 516. These axes 521 and 523 may collectively form an X-shape and may represent lines of containment that will improve stability of a wearer's foot within an upper for many types of movements (e.g., turning or changing the direction of movement, side-to-side movements, forward movements, and backward movements). As such, the wearer's foot can be contained within the upper 504 by the inlaid strand segments 522, thus limiting stretch or otherwise providing support along the axes 521 and 523, which can enhance performance of the article of footwear 500.

As shown in FIG. 8, the inlaid strand segments 522 may extend radially in a direction that is aligned, e.g., parallel or substantially parallel (e.g., being at a small angle of deviation from parallel) to additional or alternative lines of containment, in accordance with aspects hereof. In one example, inlaid strand(s) can be parallel to lines of containment. In another example, inlaid strands can be substantially aligned with lines of containment, e.g., being within 10 degrees of parallel alignment. The placement (including density) and orientation of the inlaid strand segments 522 within the knitted component 540 can be varied based on an intended activity for the article of footwear 500 as further described herein. Generally, containment provided by an inlaid strand segment on one side (e.g., lateral side 114) may be improved from containment on the other side (e.g., medial side 116) to serve as an anchor. For example, an inlaid strand segment 522 on the lateral side 514 in the forefoot region 508 may help contain the foot within the upper 504 when a wearer takes a forward, left-diagonal step. However, another inlaid strand segment 522 on the medial side 516, such as in the midfoot region 510 or heel region 512, may help to provide tension on the inlaid strand segment 522 on the lateral side 514 when containing the foot during movement.

As depicted in FIG. 8, the inlaid strand segments 522 may be formed by a radial knit process in which the inlaid strand 520 is integrated into the knitted component 540. Specifically, the knitted component 540 can be formed on a knitting machine 562 (which may have any of the features described for the knitting machine 162 shown in FIG. 3) having a first needle bed 561 and a second needle bed 563, and the process of forming the knitted component 540 may be a similar sequential knitting process as the process described in connection with FIG. 3. Thus, the knitted component 540 may be formed by starting at a heel region 512 of the medial side 516 of the knitted component 540, knitting in a knit direction 544 from the heel region 512 to the forefoot region 508, and then knitting the lateral side 514 of the knitted component 540 starting at the forefoot region 508, and finishing at the heel region 512 as shown by knit direction 544. As described with FIG. 3, knitting in the reverse of the knit direction 544 can also be performed in accordance with aspects of this disclosure.

During the knitting process, the inlaid strand 520 may be integrated with the knitted component 540 by inlaying the inlaid strand 520 as the knitting process moves in the knit direction 544, thereby forming the plurality of strand segments 522 that will extend between an outer perimeter 524 (which may form a lower portion of the upper 504 or biteline 506 when the knitted component 540 is formed into the upper 504) and a common portion of the knitted component (which may form the throat region 526). In example aspects, a combination feeder is utilized to inlay the inlaid strand 520 within a course formed by loops of another yarn strand.

In FIG. 8, the inlaid strand 520 is schematically depicted by the direction of its travel (i.e., the direction in which the inlaid strand 520 is inserted into the knitted component 540 during the knit process). As illustrated, the inlaid strand 520 alternates directions when forming successive strand segments 522. In this way, the inlaid strand 520 alternates between being inlaid toward the common portion (e.g., the throat region 526) and being inlaid toward the outer perimeter 524. In FIG. 8, the inlaid strand 520 is shown in a discontinuous manner. However, as shown in more detail in other aspects, it should be understood that the inlaid strand 520 may be a single continuous elongate member that forms the plurality of strand segments 522. In some aspects, however, the inlaid strand 520 can be a discontinuous strand. For example, the inlaid strand 520 can comprise a first strand that forms a plurality of medial-side strand segments and a second strand that forms a plurality of lateral-side strand segments.

Figure 9:
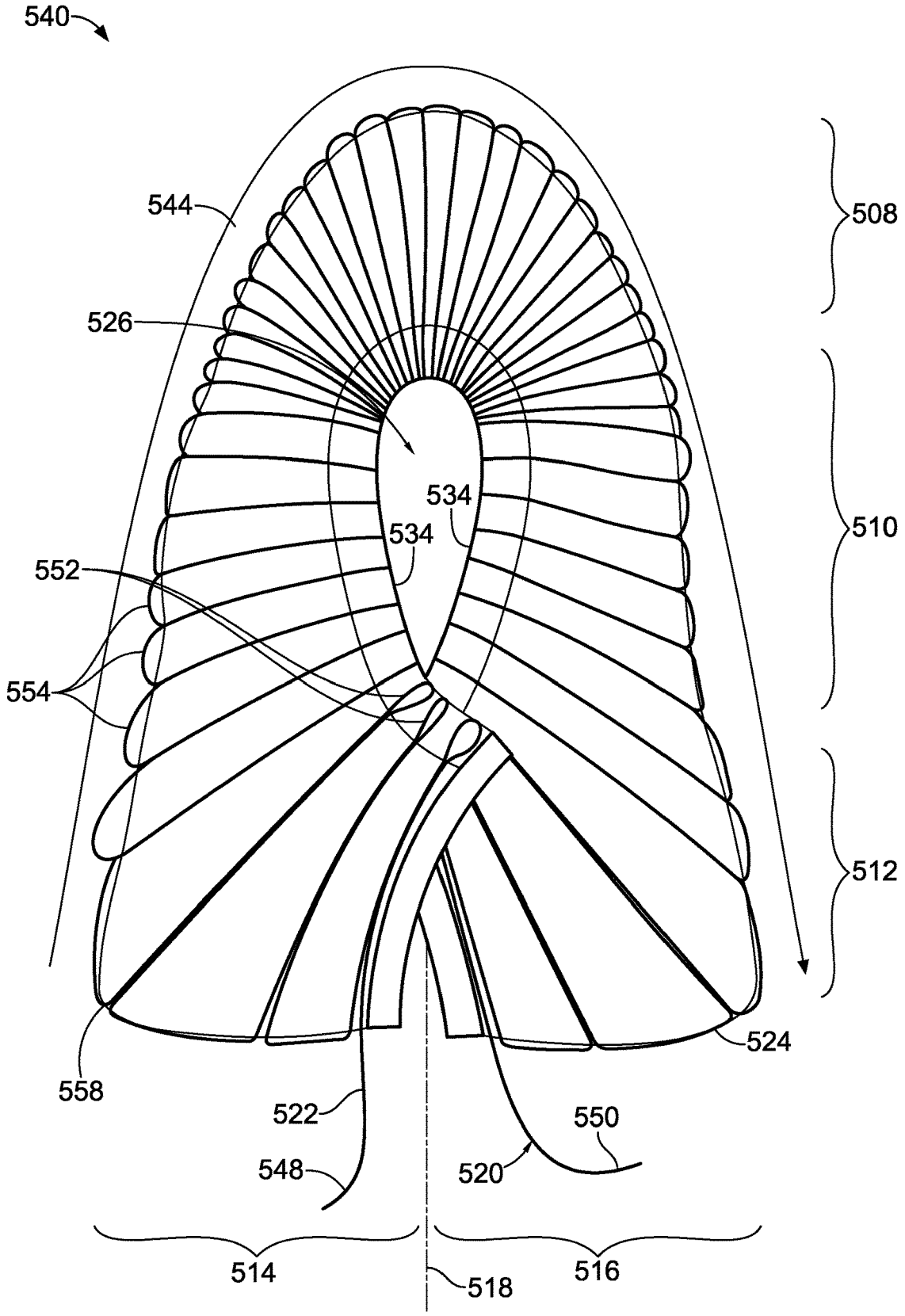
FIG. 9 depicts another schematic view of the knitted component with an inlaid strand shown in FIG. 8, in accordance with aspects hereof.

FIG. 9 illustrates another schematic view of the knitted component 540. As depicted in FIG. 9, the inlaid strand segments 522 may be formed by a continuous inlaid strand 520 that extends from a first end 548 to a second end 550. As the strand 520 is inlaid into the knitted component 540 during the knitting process, the inlaid strand 520 is integrated into the knitted component 540 in a back and forth direction between the outer perimeter 524 of the knitted component 540 and a common portion (e.g., the inner perimeter 534 defining a throat opening) to provide the plurality of inlaid strand segments 122 in various directions around the length of the foot.

At least some of the inlaid strand segments 522 may be positioned in adjacent courses such that the strand segments 522 are so close that they may be considered a single segment. These dual-strand segments, such as segment 558, may be spaced apart from one another by a greater distance than the distance between two strands forming one dual-strand segment. In this way, the inlaid strand 520 may be inlaid in a first course from the outer perimeter 524 towards the common portion (e.g., an inner perimeter 534 in the throat region 526), inlaid in an adjacent second course from the common portion to the outer perimeter 524, and then skip several courses (such as at least 4 courses) before being inlaid again from the outer perimeter 524 towards the common portion. In some aspects, one or more of these dual-strand segments may form loops, such as loops 552, at the end closest to the common portion. The loops 552 may provide a structure, such as a lace-receiving structure, for other components of the article of footwear 500, such as laces 532, to engage with. In example aspects, these loops 552 are not intermeshed with loops formed by another yarn, such as yarn(s) forming the knit element 531.

In some aspects, the strand segments 522 can have portions 554 that extend beyond the outer perimeter 524. In this instance, the portion of the inlaid strand 520 extending beyond the outer perimeter 524 can be secured to or otherwise concealed by the sole structure 502 when the sole structure 502 is attached to the knitted component 540. For example, the portions 554 extending beyond the outer perimeter 524 can be positioned between the upper 504 and the sole structure 502 and secured thereto (e.g., at the biteline 506) by adhesive and/or by other securing members. FIG. 9 also depicts how the knit direction 544 may be reversed such that it begins on the lateral side 514 and ends on the medial side 516. In aspects herein, the knitting process can include inlaying strands in different zones of the knitted component to impart localized properties, e.g., along lines of containment.

Figure 10:
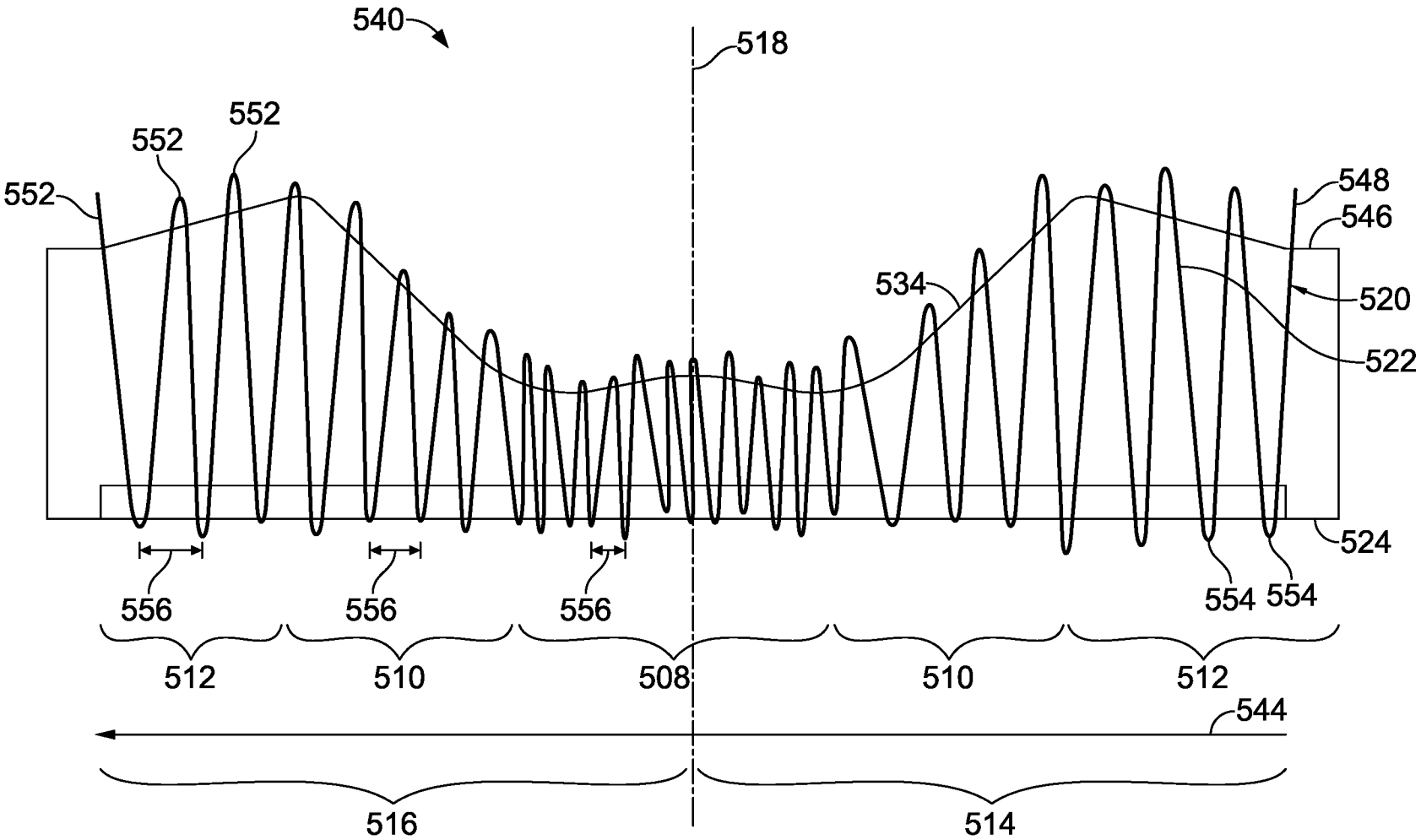
FIG. 10 depicts another schematic view of the knitted component with an inlaid strand shown in FIG. 8, in accordance with aspects hereof.

FIG. 10 depicts a schematic view of the knitted component 540 with inlaid strand segments 522 after the knitted component 540 is formed in accordance with the sequential knitting process. The knitted component 540 may be formed in the knit direction 544 that starts at the heel region 512 of a first side (e.g., lateral side 514) and continues with the midfoot region 510 of the first side, the forefoot region 508 of the first side, the forefoot region 508 of the second side (e.g., medial side 516), the midfoot region 510 of the second side, and finishes with the heel region 512 of the second side. From this construction, an upper (such as the upper 504) or a portion thereof may be formed by joining the edges of the two sides of the heel regions 112 together. As discussed above, however, in some aspects, the start and finish areas of the knitted component 540 can vary. For example, the knit direction can begin in an area of the heel region of one side and end in an adjacent area on the same side.

The number of strand segments 522 that extend between the outer perimeter 524 and the common portion of the knitted component 540 can vary. In some aspects, the number of strand segments 522 on at least one of the medial or lateral sides can range from about 2 to about 35, or from about 2 to about 30, or from about 5 to about 25, or from about 10 to about 25 strand segments. In some aspects, the number of strand segments 522 can be the same on both sides (e.g., FIG. 10). In other aspects, as discussed in more detail below, the number of strand segments on a lateral side can be different from the number of strand segments on the medial side.

In FIG. 10, the spacing of adjacent strand segments 522 of the inlaid strand 520 (i.e., the strand portions that extend between the outer perimeter 524 and the common portion, such as the inner perimeter 534 of the knitted component 540) can vary along the length of the knitted component 540. For example, in the aspect shown in FIG. 10, the strand segments 522 are spaced closer together in the forefoot region 508, spaced further apart in midfoot region 510, and yet spaced further apart in the heel region 512.

The spacing between the strand segments 522 can be defined by a distance 556 between adjacent strand segments 522 along the outer perimeter 524 of the knitted component 540. In some aspects, the distance between strand segments can vary and be within a range from about 0.25 centimeters and about 5 centimeters, from about 0.5 centimeters and about 4 centimeters, and from about 1 centimeter to about 3 centimeters. As shown in FIG. 10, the distance can vary based on the location of the strand segment in the knitted component 540. In addition, the spacing can be generally constant within a region (e.g., within 5% of each other), or the spacing can vary within a region (e.g., increase or decrease by an amount that is within a range from about 5% to about 80%, from about 10% to about 60%, and from about 15% to about 40%). In the aspect shown in FIG. 10, the spacing increases from the forefoot region 508 to the midfoot region 510 and from the midfoot region 510 to the heel region 512. However, as described in more detail below, the spacing can vary in other manners depending on the desired responsiveness (e.g., lockout, stretch-resistance, expansion-resistance, deformation) of the article of footwear 500. Spacing in a particular region can also be described as average spacing in a region, which is calculated by measuring a distance between adjacent strands and dividing by the number of spacing areas between strand segments in that region.

Table 1 below illustrates example spacings of strand segments based on the location of the strand segment in the knitted component for articles of footwear that increase in spacing from the forefoot to the heel regions, as shown in FIG. 10 for example.

TABLE 1

| Example | Forefoot region (cm) | Midfoot region (cm) | Heel region (cm) |
|---|---|---|---|
| Example 1 | 0.5-1.5 | 1.5-2.0 | 2.0-5.0 |
| Example 2 | 0.2-1.0 | 1.0-2.5 | 2.5-4.0 |
| Example 3 | 1.0 | 2.0 | 3.5-4.0 |
| Example 4 | 1.0 | 1.0-2.5 | 3.0 |
| Example 5 | 0.5-2.0 | 2.0-3.0 | 4.0 |

In some aspects, the ratio of the average spacing in the heel region to the average spacing in the forefoot region can be within a range from about 1.5:1 (e.g., an average spacing of 3.0 centimeters to 2.0 centimeters) to about 10:1 (e.g., an average spacing of 5.0 centimeters to 0.5 centimeters), or, in some aspects, the ratio can be within a range from about 2:1 to about 5:1, or in other aspects, within a range from about 3:1 to about 5:1.

The spacing can also be defined by the number of courses of the knitted component between strand segments. For example, in some aspects, the inlaid strand can be positioned at a spacing of every fourth course of the knitted component. In this aspect, there would be three courses of knitted component without the inlaid strand between courses with the inlaid strand. Table 2 below provides example spacing based on the number of courses of the knitted component without the inlaid strand between courses that have the inlaid strand.

TABLE 2

| Example | Forefoot region (Courses between strands) | Midfoot region (Courses between strands) | Heel region (Courses between strands) |
|---|---|---|---|
| Example 6 | 2-6 | 3-10 | 3-20 |
| Example 7 | 3 | 5 | 10 |
| Example 8 | 2-10 | 5-15 | 5-20 |
| Example 9 | 4 | 7 | 10 |

In some aspects, the ratio of the average spacing based on the number of courses between strand segments in the heel region to the average number of courses between the strand segments in the forefoot region can be within a range from about 1.5:1 (e.g., 3 courses between strand segments to 2 courses between strand segments) to about 10:1 (e.g., 20 courses between strand segments to 2 courses between strand segments), or in some aspects, the ratio can be between within a range from about 2:1 to about 5:1, or, in other aspects, within a range from about 3:1 to about 5:1. This ratio of average spacing can be adjusted based on where a higher degree of lockdown is desired in a knitted component, e.g., with fewer courses between strand segments providing a higher degree of lockdown.

Figure 11:
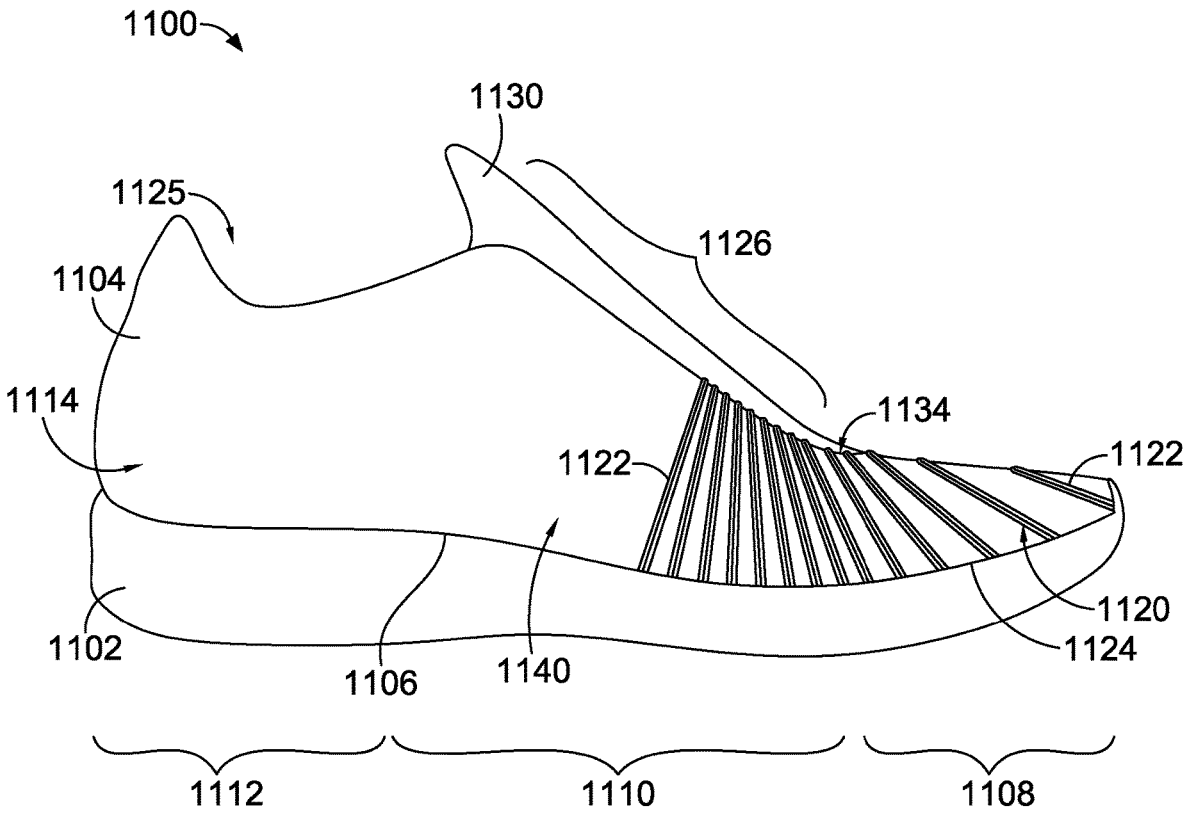
FIG. 11 depicts a side view of an example article of footwear formed with a knitted component having an inlaid strand, in accordance with aspects hereof.
Figure 12:
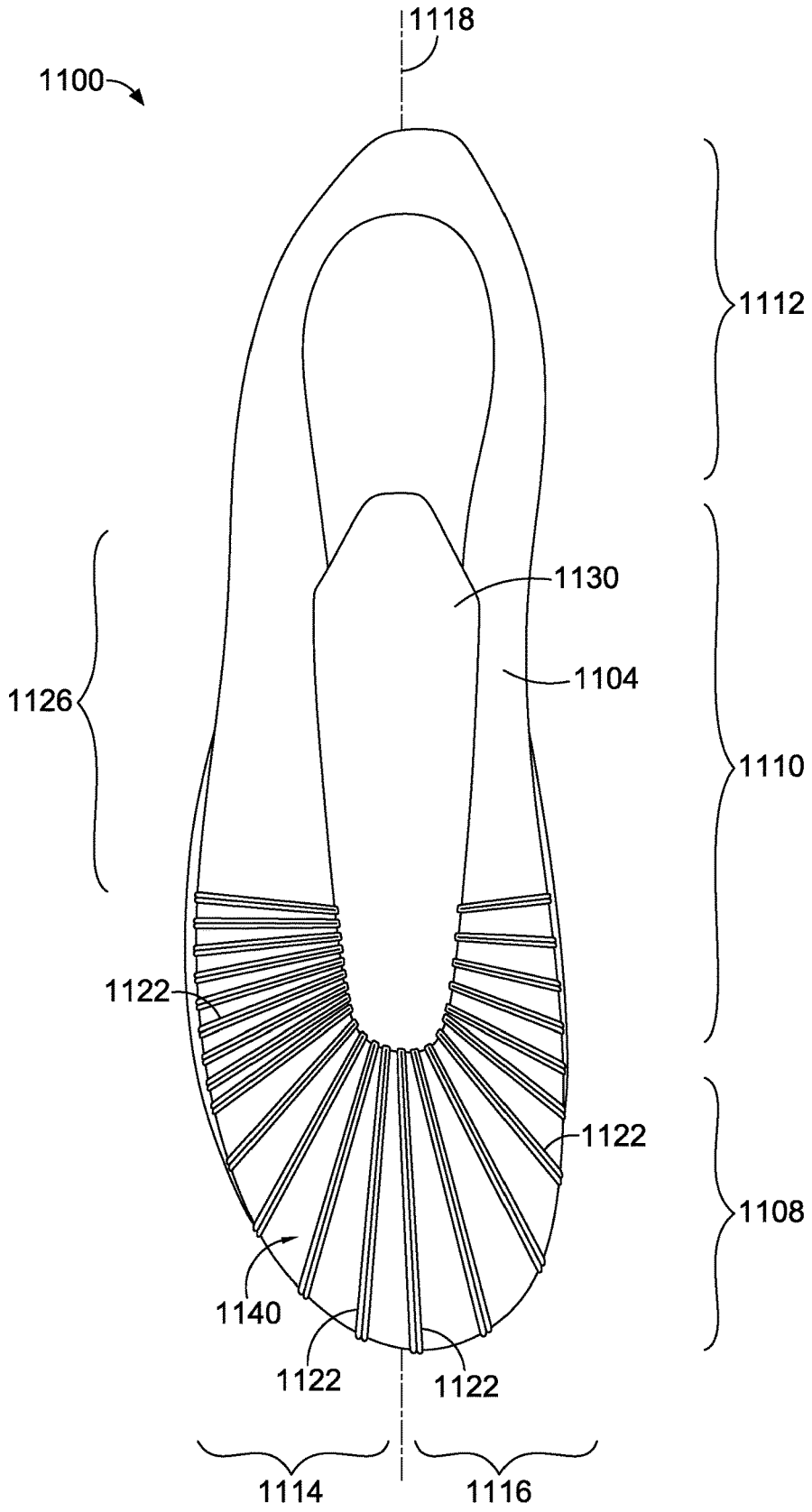
FIG. 12 depicts a top side view of the example article of footwear shown in FIG. 11, in accordance with aspects hereof.

FIGS. 11 and 12 depict a side view and a front perspective view, respectively, of an article of footwear 1100 and its components, according to another example of the present disclosure. Except where otherwise indicated, the article of footwear 1100 may include any of the features described with respect to the article of footwear 100 shown in FIGS. 1 and 2 and/or the article of footwear 500 shown in FIGS. 5 and 6. As such, the article of footwear 1100 comprises a sole structure 1102 and an upper 1104 that is coupled to the sole structure 1102 and forms a foot-receiving cavity.

The upper 1104 defines a void within the article of footwear 1100 for receiving and securing a foot relative to the sole structure 1102. Access to the void is provided by an ankle opening 1125 located in at least a heel region 1112. The upper 1104 may also include a throat region 1126 disposed in the midfoot region 1110 between the ankle opening 1125 and a forefoot region 1108. The throat region 1126 may be configured to cover a top side of the wearer's foot and, therefore, form part of a top side (or overfoot region) of the upper 1104 between a lateral side 1114 and the medial side 1116. In the depicted aspect, the upper 1104 includes a tongue portion, e.g., the tongue 1130. The article of footwear 1100 can also include a closure system, such as laces or a lacing system as shown in other figures, in the throat region 1126 to adjust the foot-receiving cavity.

At least a portion of the upper 1104 may be formed of at least one knitted component 1140, which may be formed as a single integral one-piece element during a knitting process. Unless otherwise indicated, the knitted component 1140 shown in FIGS. 11 and 12 may have any of the features described with respect to the knitted component 140 shown in FIGS. 1-3 and/or the knitted component 540 shown in FIGS. 5-8. As such, the knitted component 1140 may form the forefoot region 1108 and the midfoot region 110. The knitted component 1140 may further form the heel region 1112. These regions 1108, 1110, and 1112 may be integrally knitted together. Additionally, the knitted component 1140 may have radially extending knit courses that extend from an outer perimeter 1124 of the knitted component to a common portion of the knitted component 1140. The common portion may include at least part of the throat region 1126, which may extend along a longitudinal axis 1118 of the knitted component 1140.

The knitted component 1140 may also include one or more inlaid strands, such as an inlaid strand 1120, that define a plurality of strand segments 1122. The inlaid strand 1120 passes between various loops of a base knit element, which may be referred to herein as a knit element. The inlaid strand 1120 may be incorporated in a similar manner as described with respect to the inlaid strand 520 shown in FIGS. 5-8. That is, the inlaid strand 1120 may primarily extend, without loops, within a course of loops formed by another strand (e.g., yarn). Any of the features of the yarn forming the knit element 531 and/or the inlaid strand 520 may apply to the knitted component 1140 and inlaid strand 1120.

Each of the inlaid strand segments 1122 extends along a course of knitted loops in the knitted component 1140 and, as such, also radially extends between the outer perimeter 1124 of the knitted component 1140 and the common portion, which may be the throat region 1126. Similar to inlaid strand segments 522 shown in FIGS. 5-10, the inlaid strand segments 1122 may extend from the outer perimeter 1124 of the knitted component 1140 to the common portion in various directions across the forefoot region 1108 and the midfoot region 1110. In this manner, the inlaid strand 1120 forms a plurality of strand segments 1122 that radially fan-out from a common portion (i.e., the throat region 1126 as shown in FIG. 12). In some aspects, the inlaid strand segments 1122 are absent from the heel region 1112 as shown in FIGS. 11 and 12, but in other aspects, such as those shown in FIGS. 5-10, the heel region 1112 may include one or more strand segments.

Additionally, the common portion of the knitted component 1140 may be a smaller area than the common portion of the knitted components 150 and 540, which may extend along the entire or over 50% of the length of the respective throat region. Instead, the common portion of the knitted component 1140 may be only a forward portion of the throat region 1126. In some aspects, the common portion can be within 5 centimeters, or in some aspects, within 2.5 centimeters or within 1.25 centimeters, (i.e., in a longitudinal direction) of the forward-most portion of the throat region 1126. As used herein, the forward-most portion of the throat region 1126 may be the forward-most edge of the knitted component 1140 that forms the throat region 1126 of an upper, which may be where the throat region 1126 meets the forefoot region 1108.

As previously described, the location and density of t medial side 111*he* inlaid strand segments may impact the degrees and lines of containment within an upper, and in addition, the varying locations and/or densities of the inlaid strand segments may optimize containment for various activities or movements. The top side view of the article of footwear 1100 in FIG. 12 shows that at least a portion of the lateral side 1114, such as a midfoot region 1110 on the lateral side 1114, has a greater density of inlaid strand segments 1122 than the corresponding portion on the medial side 1116. The different densities are caused by different spacing between the inlaid strand segments 1122. Specifically, the distance between adjacent strand segments 1122 on the lateral side 1114 in the midfoot region 1110 is less than the distance between adjacent strand segments 1122 on the medial side 1116 in the midfoot region 1110. The greater density of strand segments 1122 on the lateral side 1114 may help to keep the wearer's foot contained on the lateral side 1114 of the upper 1104, and therefore not slide off the sole structure 1102 on the lateral side 1114. In some aspects, the article of footwear 1100 may be intended to be worn when movement in a generally counter-clockwise pattern, such as a person running around a running track. As a person moves, such as runs, around a running track, the foot is frequently being pushed towards the side of the track, which may be on the medial side of an article of footwear intended for the right foot (as in the article of footwear 100) when moving counter-clockwise around the track. Thus, greater density of radially-extending inlaid strand segments 1122 on the opposite side (lateral side 1114) of the article of footwear 1100 helps contain the foot by counteracting the natural force pushing the wearer's right foot towards the track. The opposite shoe (intended to be worn on the wearer's left foot) similarly can have an asymmetrical density of inlaid strand segments between the lateral and medial sides but may have a greater density of inlaid strand segments on the medial side of the upper, which would be the side facing away from the track for footwear worn on the left foot. Further, the inlaid strand segments 1122 may be positioned within the forefoot region 1108 and at least part of the midfoot region 1110 and not positioned within the heel region 1112. This arrangement may be advantageous in an article of footwear 1100 intended for activities with primarily forward movements, such as running.

Figure 13:
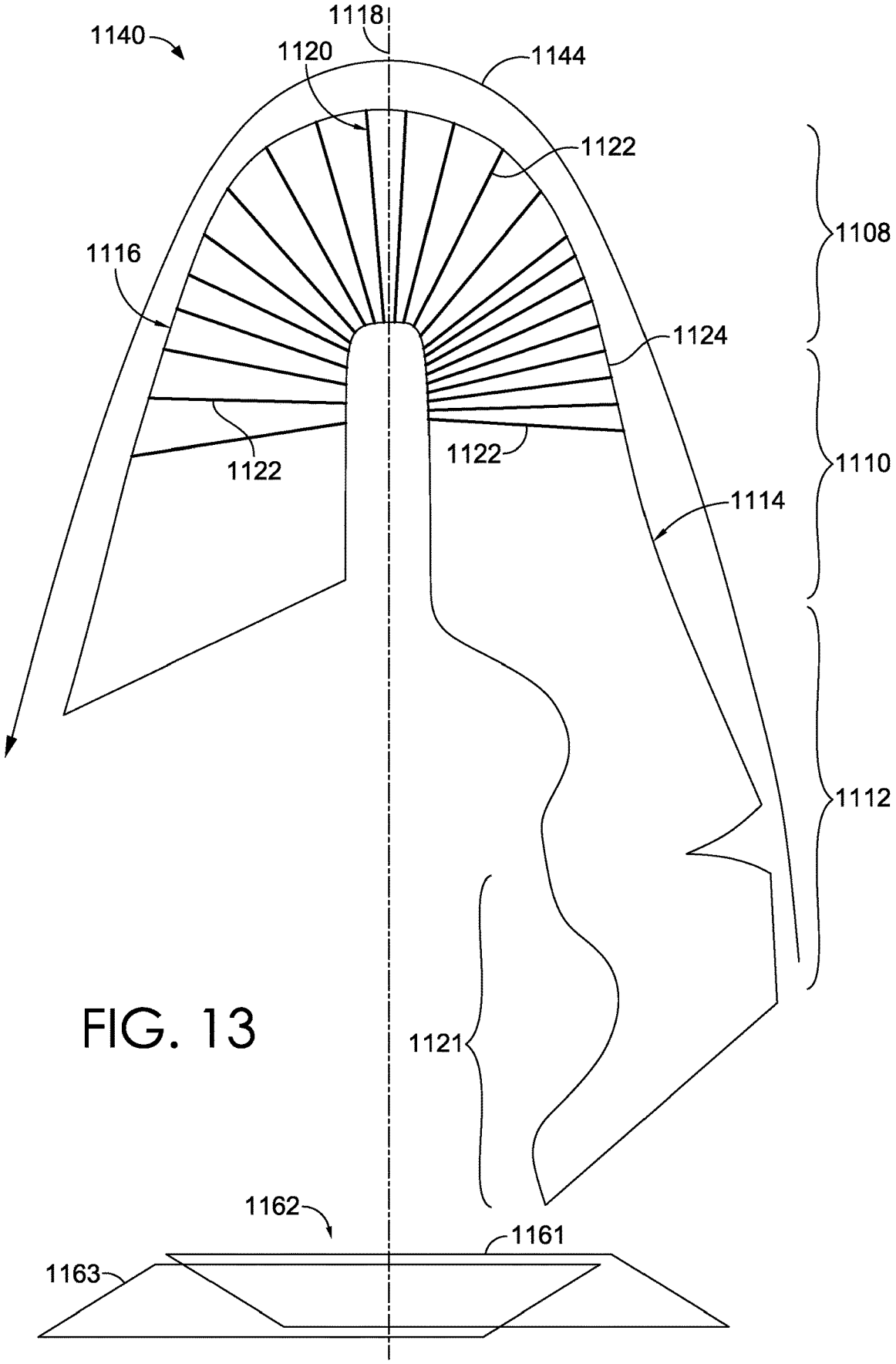
FIG. 13 depicts a schematic view of an example knitted component for the example article of footwear shown in FIG. 11, in accordance with aspects hereof.

FIG. 13 depicts a schematic view of the knitted component 1140 having radially extending inlaid strand segments 1122. In the depicted aspect, courses of knitted loops are omitted in FIG. 13 to simplify the drawing, but it should be understood that the knitted component 1140 depicted in FIG. 13 may include radially-extended courses of knitted loops similar to the courses 142 described with respect to FIG. 3. These courses may include an inlaid strand segment 1122 or may not include an inlaid strand segment 1122.

The inlaid strand segments 1122 may be more dense (e.g., have a closer spacing or, stated differently, be located closer to one another) on the lateral side 1114 than the strand segments 1122 located on the medial side 1116 in the midfoot region 1110. As previously described, the spacing between the inlaid strand segments 1122 may be defined as a distance between the strand segments 1122 on the outer perimeter 1124. Any of the distances described with respect to FIG. 10 may be the distances between adjacent strand segments 1122 in the midfoot region 1110 on the lateral side 1114, the forefoot region 1108, and/or the midfoot region 1110 on the medial side 1116 of the upper 1104. In example aspects, the ratio of the average spacing, based on the number of courses, in the midfoot region 1110 on the lateral side 1114 to the average spacing, based on the number of courses, in the midfoot region 1110 on the medial side 1116 may be within a range of about 1:1.25 to 1:8, a range from about 1:1.5 to 1:5, and a range from about 1:2 to 1:3. In an example aspect, the ratio is 1:1.5 or 1 course between strand segments 1122 on the lateral side 1114 for every 1.5 courses between strand segments 1122 on the medial side 1116. For instance, there may be two courses between strand segments 1122 on the lateral side 1114 and three courses between strand segments 1122 on the medial side 1116.

Additionally, as depicted in FIG. 13, the inlaid strand segments 1122 may be formed sequentially and in which a single continuous inlaid strand 1120 is integrated into the knitted component 1140. Specifically, the knitted component 1140 can be formed on a knitting machine 1162 (which may have any of the features described for the knitting machine 162 shown in FIG. 3) that includes a front needle bed 1161 and a back needle bed 1163, and the process of forming the knitted component 1140 may be a sequential knitting process following the knit direction 1144, similar to the processes described in connection with FIG. 4. The knitted component 1140 may have an asymmetrical shape along the longitudinal axis 1118 when it comes off the knitting machine 1162, which may result from the sequential knitting process starting at a heel portion on one side and ending with an adjacent portion on the same side. In this example, an area 1121 of the heel region 1112 that will form the medial side 1116 of the upper once the knitted component 1140 is formed into an upper is knit first, and then the rest of the heel region 1112 on the lateral side 1114 is knit, then the midfoot region 1110 on the lateral side 1114 is knit, the forefoot region 1108 is knit, and then the midfoot region 1110 on the medial side 1116 is knit. It should be understood that the same shape of the knitted component 1140 shown in FIG. 13 may be achieved by knitting in the reverse sequence.

As described with respect to the knitted component 440 of FIG. 4, the knitted component 1140 may still include courses that do not extend towards the common portion when the knitting component 1140 is in the laid-out configuration shown in FIG. 13 but may be re-oriented to be radially extending between the outer perimeter 1124 and the common portion after the knitted component 1140 is folded to form the shape of the upper 1104.

During the knitting process, the inlaid strand 1120 may be integrated with the knitted component 1140 by inlaying the inlaid strand 1120 as the knitting process moves in the knit direction 1144, thereby forming the plurality of strand segments 1122 that will extend between an outer perimeter 1124 (which may form a lower portion of the upper 1104 or biteline 1106 when the knitted component 1140 is formed into the upper 1104) and a common portion of the knitted component (which may form an upper portion of the upper 1104). In example aspects, a combination feeder is utilized to inlay the inlaid strand 1120 within a course formed by loops of another yarn strand.

Figure 14:
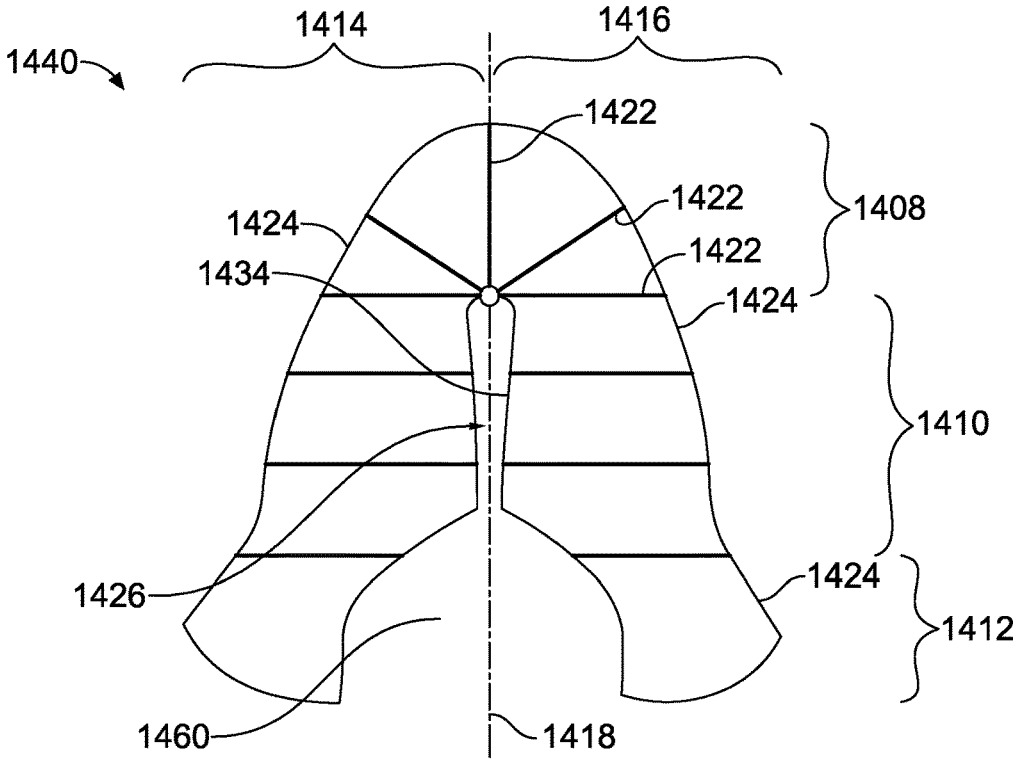
FIG. 14 depicts a schematic view of another example knitted component with an inlaid strand, in accordance with aspects hereof.
Figure 15:
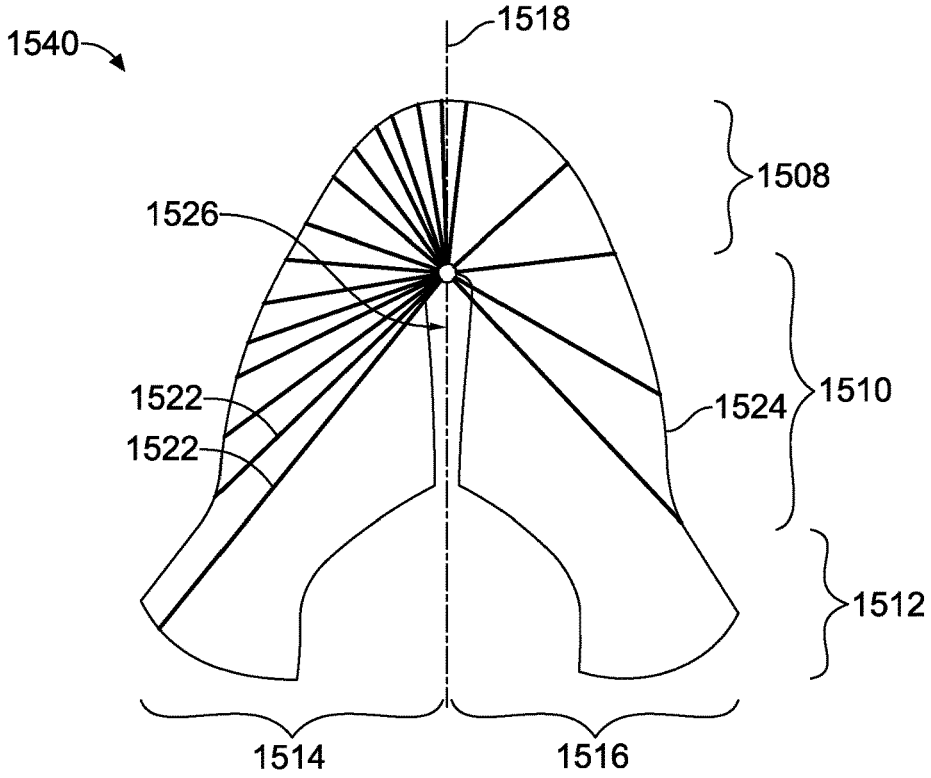
FIG. 15 depicts a schematic view of another example knitted component with an inlaid strand, in accordance with aspects hereof.
Figure 16:
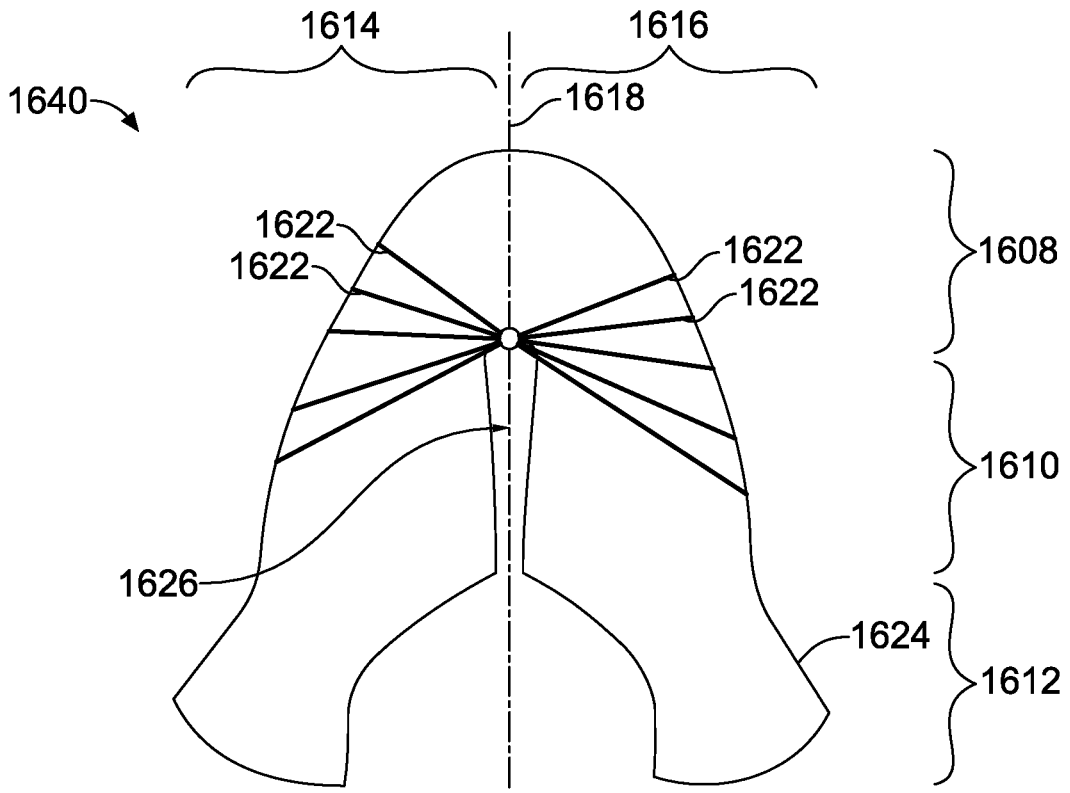
FIG. 16 depicts a schematic view of another example knitted component with an inlaid strand, in accordance with aspects hereof.

FIGS. 14-16 illustrate additional example aspects in which a knitted component is formed with an inlaid strand that extends from a perimeter of the knitted component to a common portion of the knitted component, in accordance with aspects hereof. The location, the density, and the angle (which may be based on the location of the common portion) of the inlaid strand segments within these additional examples may vary based on desired containment for various activities and intended uses. Unless otherwise indicated herein or shown in the drawings, any of the knitted components in FIGS. 14-16 may include any of the features of the knitted components 140, 540, and/or 1140. As such, any of the knitted components in FIGS. 14-16 may be formed in the sequential knitting process described with respect to the knitted components 140, 540, and/or 1140 such that the medial and lateral sides may be knit separately and not at the same time using at least some of the same needles. Further, any of the knitted components in FIGS. 14-16 may form all or part of an upper for an article of footwear having any of the features described with respect to the articles of footwear 100, 500, and/or 1100.

FIG. 14 illustrates an example knitted component 1440 in which the strand segments 1422 of an inlaid strand extend between the outer perimeter 1424 of the knitted component 1440 and a common portion of the knitted component 1440. In this aspect, the common portion includes a larger portion of the knitted component 1440 compared to the common portion of the knitted component 540 of FIGS. 5-8. Specifically, the common portion in FIG. 14 is part of the knitted component 1440 that defines the throat region 1426 and that defines an ankle opening 1460. Because of the larger area of the common portion, at least some inlaid strand segments 1422 in the midfoot and heel regions 1410 and 1412 may be parallel or substantially parallel to each other.

The knitted component 1440 can be formed by inlaying the strand during the knitting process. In particular, the strand can be inlaid at a first region of one side of the knitted component (e.g., a heel region of the medial or lateral side) and then the knitted component can be completed by knitting along a knit direction until the knitted component is fully constructed as described elsewhere herein. As in the previous aspects, the strand segments 1422 extend throughout the forefoot region 1408, the midfoot region 1410, and the heel region 1412.

As shown in FIG. 14, the spacing of the radially-extending inlaid strand segments 1422 in this aspect is more uniform throughout the longitudinal length of the upper than in the previous aspect. For example, the smallest distance between adjacent strand segments 1422 in all regions (forefoot region 1408, midfoot region 1410, and heel region 1412) can be within 50% of the largest distance, within 40% of the largest distance, or within 25% of the largest distance. Thus, for example, in one aspect, the largest spacing (e.g., in the heel region) can be 4 centimeters and the smallest spacing of adjacent strand segments (e.g., in either the midfoot or forefoot) can be equal to or greater than 3 centimeters (e.g., within 25% of 4 centimeters).

Similarly, the spacing of the strand segments 1422 of the inlaid strand by courses based on the number of courses of the knitted component without an inlaid strand between courses that have an inlaid strand can be more uniform than in previous aspects. For example, the smallest number of courses between adjacent strand segments can be within 50% of the largest number of courses between adjacent strand segments, within 40% of the largest number of courses between adjacent strand segments, or within 25% of the largest number of courses between adjacent strand segments. Thus, for example, in one aspect, the largest spacing (e.g., in the heel region) could be 10 courses between adjacent strand segments and the smallest spacing (e.g., in either the midfoot or forefoot) can be between 5 and 10 courses (e.g., within 50%).

FIG. 15 depicts another aspect of a knitted component 1540 with radially-extending knit courses and inlaid strand segments 1522. The strand segments 1522 of the inlaid strand extend between the perimeter 1524 of the knitted component 1540 and a common portion of the knitted component 1540. In this aspect, the common portion is smaller than the common portion of the knitted component 540 of FIGS. 5-8. The common portion of the knitted component 1540 shown in FIG. 15 includes only a forward portion of the throat region 1526. Thus, in some aspects, the common portion can be within a smaller area of the throat region 1526, such as within 5 centimeters, or in some aspects, within 2.5 centimeters or within 1.25 centimeters (i.e., in a longitudinal direction) of the forward-most portion of the throat region 1526. As used herein, the forward-most portion of the throat region 1526 may be the forward-most edge of the knitted component that forms the throat region 1526 of an upper, which may be where the throat region 1526 meets the forefoot region 1508. A smaller common portion may result in the inlaid strand segments being oriented along a greater number of different angles around a wearer's foot.

As depicted in FIG. 15, there may be an asymmetrical pattern of the strand segments 1522. In this example, the knitted component 1540 includes five strand segments 1522 on the medial side 1516, three strand segments 1522 on the lateral side 1514, and one strand segment extending along the longitudinal axis in the forefoot region 1508. Thus, in this aspect, the number of strand segments positioned on one side (e.g., the lateral side) can be greater than the number of strand segments positioned on the other side (e.g., the medial side). As described with respect to the knitted component 1140, such an asymmetrical positioning of strand segments 1522 may be advantageous for articles of footwear intended for certain activities with movement to one side favored or used more frequently than movement to another side. In some aspects, the number of strand segments on one side can be equal to or less than ½ of the number of strand segments on the other side. In other aspects, the number of strand segments on one side can be equal to or less than ⅓ of the number of strand segments on the other side.

For asymmetrical aspects such as the one depicted in FIG. 15, it should be understood that the lateral and medial sides can be reversed. Thus, for example, either the medial or lateral side can have the greater number of strand segments for concentrated radial reinforcement.

FIG. 16 depicts another aspect of a knitted component 1640 formed with inlaid strand segments 1622 extending between an outer perimeter 1624 of the knitted component 1640 and a common portion of the knitted component 1640. Like the common portion of the knitted component 1540 shown in FIG. 15, the common portion of the knitted component 1540 includes only a forward portion (e.g., a forward half) of a throat region 1626. In some aspects, the common portion of the knitted component 1640 can be within five centimeters, or in some aspects, within 2.5 centimeters or within 1.25 centimeters, (e.g., in a longitudinal direction) of the forward-most portion of the throat region 1626.

In this aspect, the strand segments 1622 of the inlaid strand extend through portions of the forefoot region 1608 and midfoot region 1610, but not in the heel region 1612. An equal number of strand segments (in this example case, five) can be provided on each side (lateral side 1614 and medial side 1616). Compared to other knitted components disclosed herein, the knitted component 1640 does not include as many strand segments 1622 in the forefoot region 1608. Specifically, the knitted component 1640 does not include any strand segments in the central portion of the forefoot region 1608 adjacent to the longitudinal axis 1618. This lack of strand segments 1622 in the forefoot region may be beneficial where the article of footwear is intended for activities with less forward motion.

In one aspect, a radial knit process or a sequential knit process can be performed such that medial and lateral sides of a knitted component can generally be formed sequentially, rather than simultaneously. For example, instead of forming medial and lateral sides simultaneously, all (or substantially all, i.e., within 5% by length) of the medial side can be formed, then all (or substantially all, i.e., within 5% by length) of the lateral side can be formed next. Alternatively, the lateral side can be formed first and the medial side can be formed subsequently. In some aspects, a portion of a first side (either the medial or lateral) can be formed first, and then the second side (e.g., the other side) can be formed before completing the knitted component by knitting the remaining portion of the first side. In some aspects, a reverse sequence may be used. In this way, a plurality of adjacent courses forming at least part of a first side (i.e., the medial or lateral side) may be knit prior to a plurality of adjacent courses forming at least part of a second side (i.e., the other of the medial or lateral side).

Figure 17:
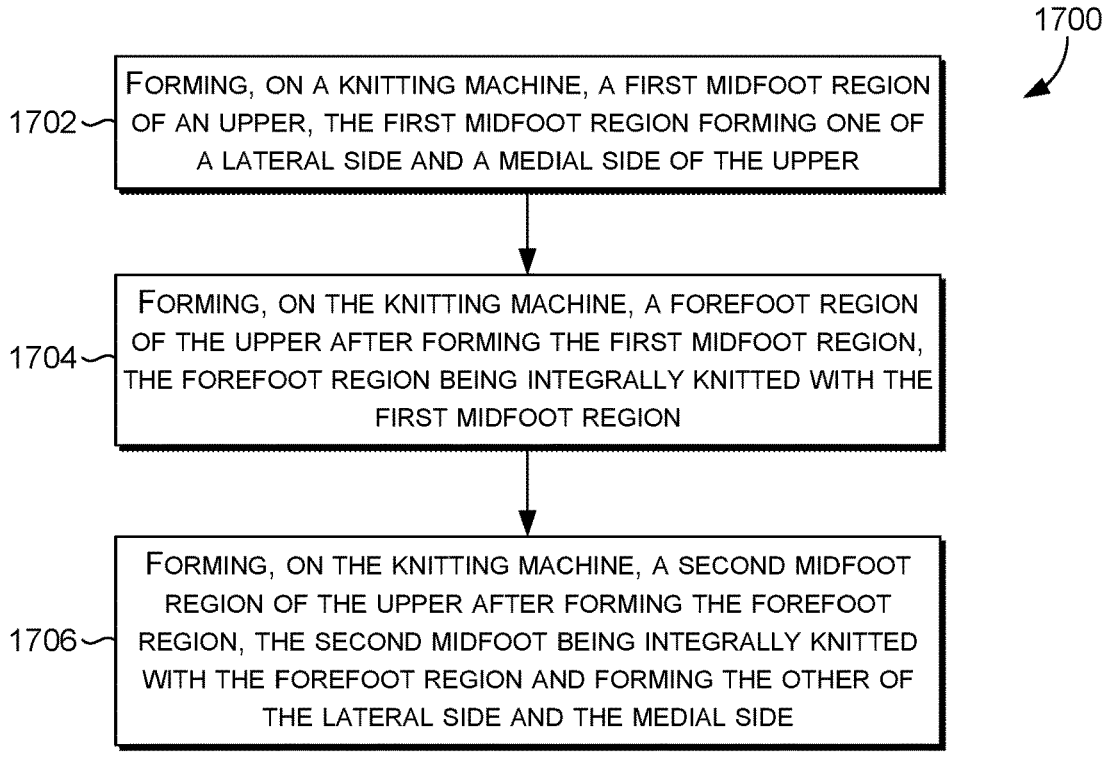
FIG. 17 depicts a block diagram of an example method of manufacturing a knitted component, in accordance with aspects hereof.

FIG. 17 depicts a block diagram of an example method 1700 of manufacturing a knitted component, e.g., the knitted components 140, 540, and/or 1140 shown in FIGS. 1-3, 5-8, and 11-13, respectively, in accordance with aspects hereof. The method 1700 includes blocks 1702-1706, but is not limited to this selection of elements. In block 1702, the method 1700 includes forming, on a knitting machine, e.g., the knitting machine 162 shown in FIG. 3, a first midfoot region of an upper, e.g., the midfoot region 110 of the upper 104 shown in FIG. 3, the first midfoot region forming one of a lateral side and a medial side, e.g., the lateral and medial sides 114, 116 of the upper 104 shown in FIG. 3. In block 1704, the method 700 includes forming, on the knitting machine, a forefoot region of the upper, e.g., the forefoot region 108 of the upper 104 shown in FIG. 3, after forming the first midfoot region, the forefoot region being integrally knitted with the first midfoot region, e.g., through a single knitting process performed on a knitting machine. In one example, the forefoot region can be a toe region formed from one or more wedges, e.g., a plurality of wedges. In block 1706, the method 1700 includes forming, on the knitting machine, a second midfoot region of the upper, e.g., the midfoot region 110 of the upper 104 shown in FIG. 3, after forming the forefoot region, the second midfoot region being integrally knitted with the forefoot region and forming the other of the lateral side and the medial side. The first midfoot region and the second midfoot region can each be formed from one or more wedges as described herein.

Figure 18:
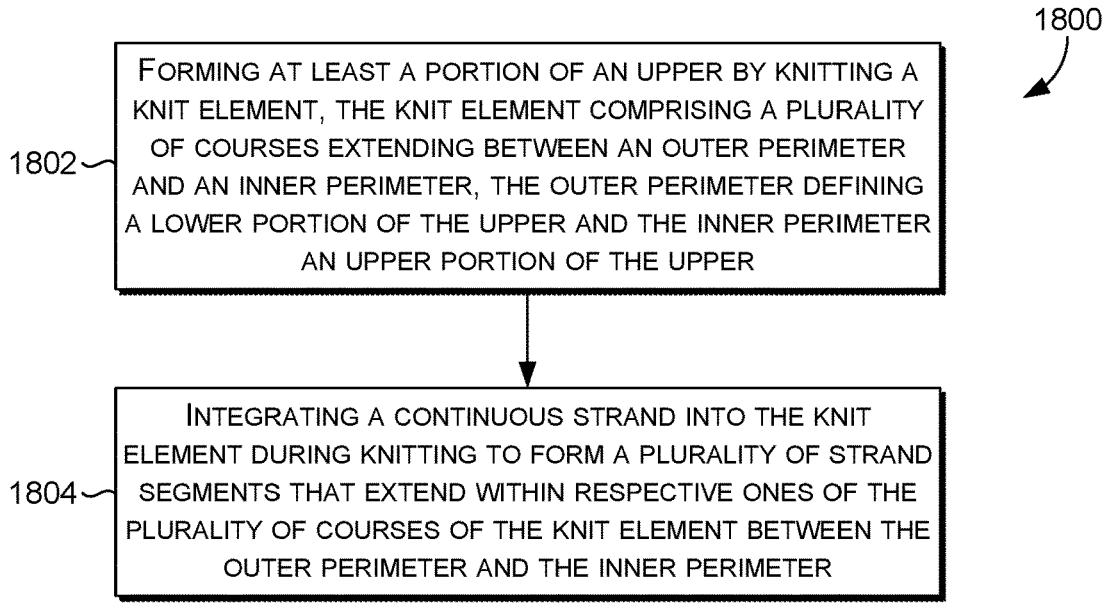
FIG. 18 depicts a block diagram of an example method of forming an article of footwear, in accordance with aspects hereof.

FIG. 18 depicts a block diagram of an example method 1800 of forming an article of footwear, e.g., the article of footwear 500 shown in FIG. 5, in accordance with aspects hereof. The method 1800 includes blocks 1802 and 1804, but is not limited to this selection of elements. In block 1802, the method 1800 includes forming at least a portion of an upper, e.g., the upper 104 shown in FIG. 1, by knitting a knit element, e.g., the knit element 531 shown in FIG. 7, the knit element comprising a plurality of courses extending between an outer perimeter and an inner perimeter, e.g., as shown in FIG. 3, the outer perimeter defining a lower portion of the upper and the inner perimeter defining an upper portion of the upper, e.g., like the inner and outer perimeters 134 and 124 shown in FIG. 3. In block 1804, the method 1800 includes integrating a continuous strand, e.g., the strand 520 shown in FIG. 7, into the knit element during knitting to form a plurality of strand segments, e.g., the strand segments 522 shown in FIG. 8, that extend within respective ones of the plurality of courses of the knit element between the outer perimeter and the inner perimeter.

Figure 19:
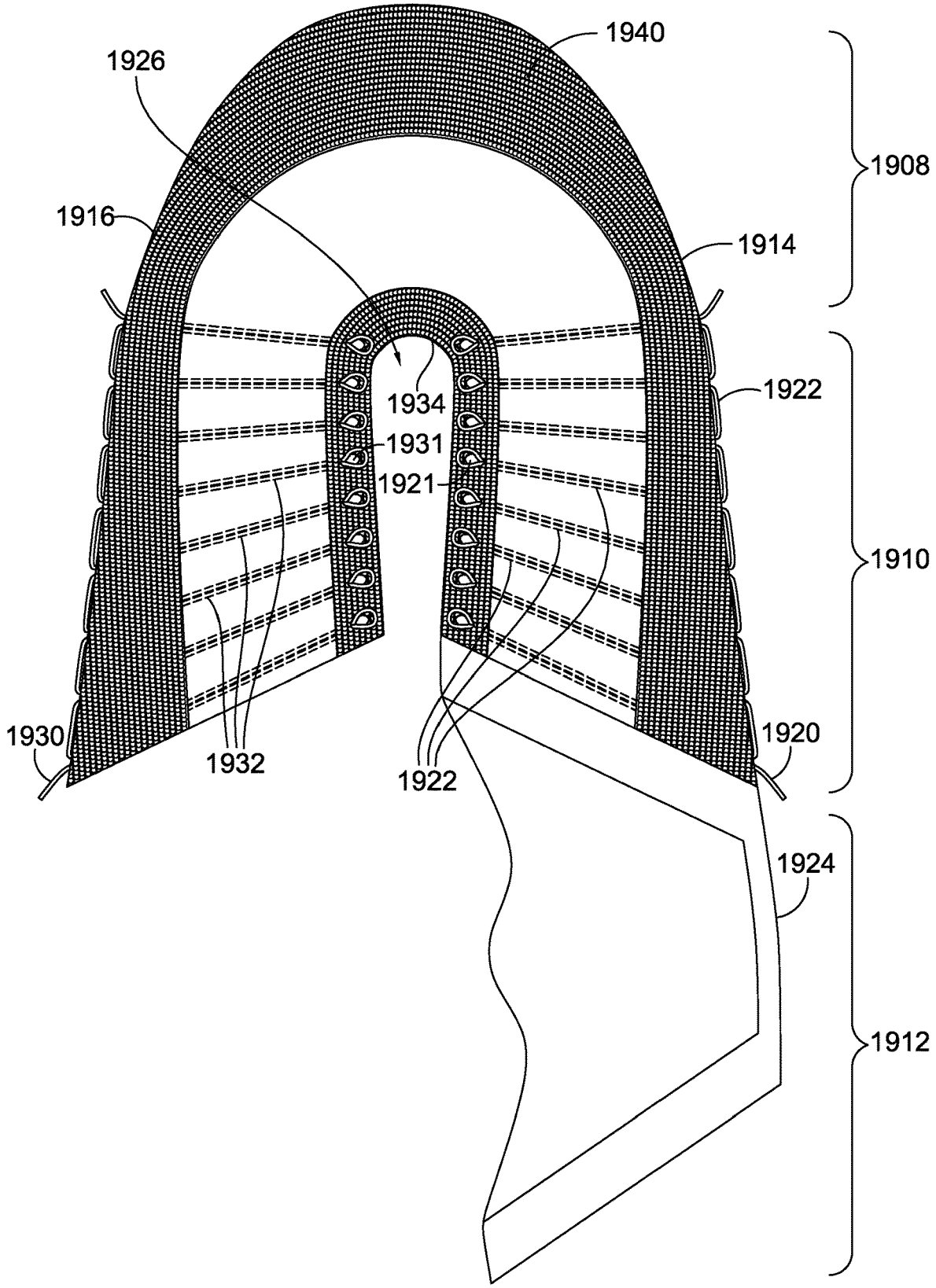
FIG. 19 depicts a knitted component with inlaid strands located in certain areas of the knitted component, in accordance with aspects hereof.

FIG. 19 depicts an example knitted component 1940 with inlaid strands 1920, 1930 positioned in certain sections of the knitted component 1940, in accordance with aspects hereof. The knitted component 1940 can form at least part of an upper for an article of footwear as discussed herein. In FIG. 19, the knitted component 1940 is formed to include a forefoot region 1908, a midfoot region 1910, and a heel region 1912. In addition, the knitted component 1940 includes an outer perimeter 1924 and an inner perimeter 1934, e.g., that is located around a throat region 1926. The knitted component 1940 can be formed as a single, unitary, knit element, e.g., being knitted in a single continuous knitting process on a knitting machine. In addition, the knitted component 1940 can be formed to include an inner knit layer and an outer knit layer, e.g., that are interconnected to collectively form a base textile. FIG. 19 further depicts how inlaid strands 1920, 1930 are integrated such that each inlaid strand 1920, 1930 extends between the inner and outer knit layers of the base textile, i.e., extends at least partially through the base textile, such that the inlaid strands 1920, 1930 are at least partially visible through the base textile of the knitted component 1940.

Looking still at FIG. 19, it can be seen how the inlaid strand 1920 is located on the lateral side 1914 of the knitted component 1940 and the inlaid strand 1930 is located on the medial side 1916 of the knitted component 1940. In addition, the inlaid strand 1920 forms a plurality of strand segments 1922 that extend from the perimeter 1924 towards a common portion of the knitted component 1940 on the lateral side 1914, and the inlaid strand 1930 forms a plurality of strand segments 1932 that extend from the perimeter 1924 towards the common portion of the knitted component 1940 on the medial side 1916. In addition, at least a portion of each set of strand segments 1922, 1932 are connected with loops located along their corresponding parts of the outer perimeter 1924 of the knitted component 1940. In addition, the strand segments 1922, 1932 also form loops 1921, 1931 adjacent to the inner perimeter 1934 of the knitted component 1940, e.g., forming at least part of apertures for receiving lacing elements.

With the knitted component 1940 shown in FIG. 19 at least a portion of the strand segments 1922 extend through knit courses towards the inner perimeter 1934 at an angle relative to each other, e.g., forming an at least partially radial configuration about a common portion, e.g., the throat region 1926, and at least a portion of the strand segments 1932 extend through knit courses towards the inner perimeter 1934 at an angle relative to each other, e.g., forming an at least partially radial configuration about a common portion, e.g., the throat region 1926. However, the strand segments 1922, 1932 are generally absent from the toe area of the forefoot region 1908. This produces localized reinforcement and/or containment at the medial and lateral sides 1916, 1914, and less reinforcement and/or containment in the forefoot region 1908. To impart such reinforcement and/or containment, the strands 1920, 1930 can be high-tenacity yarns, cables, filaments, mono-filaments, multi-filaments, or the like. To state it differently, the strands 1920, 1930 can be formed or chosen to have a higher tenacity, stretch-resistance, and/or tensile strength than yarns forming the base textile of the knitted component 1940 to impart reinforcement and/or containment in the direction of the common portion.

Figure 20:
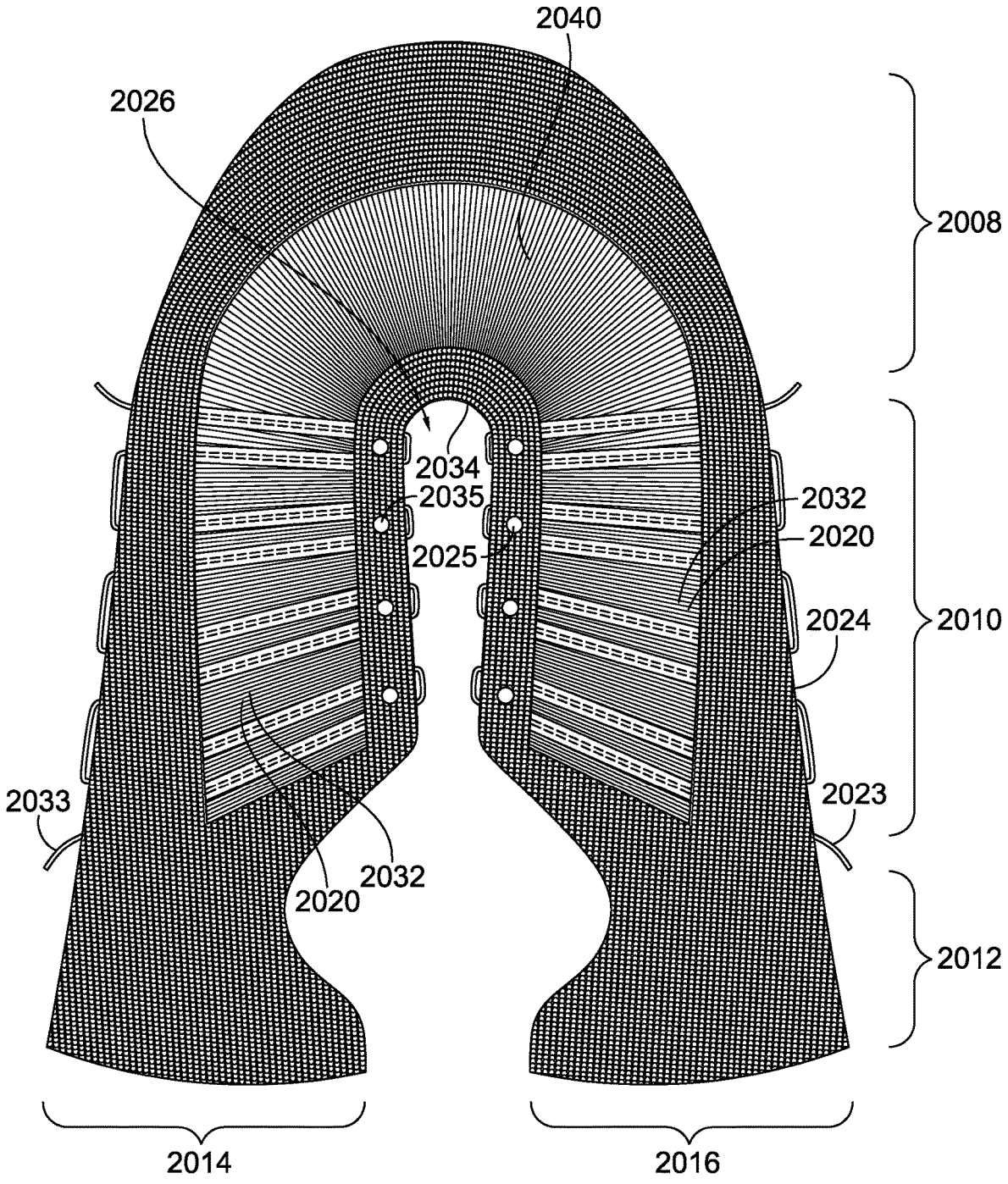
FIG. 20 depicts a knitted component with substantially continuous inlays, in accordance with aspects hereof.

FIG. 20 depicts a knitted component 2040 with a substantially continuous inlay extending around the knitted component 2040, in accordance with aspects hereof. The knitted component 2040 includes similar elements as other knitted components described herein. In addition, the knitted component 2040 includes continuously inlaid strands 2020, 2032 that are inlaid such that the inlaid strands 2020, 2032 extend from the outer perimeter 2024 toward the inner perimeter 2034 substantially adjacent to each other. For example, in one aspect, the inlaid strands 2020, 2032 extend along directly adjacent courses in a sequenced or alternating fashion. The inlaid strands 2020, 2032 also are inlaid to extend towards and about a common portion of the knitted component 2040, e.g., a throat region 2026, thereby forming a substantially radial configuration about the common portion. In FIG. 20, the inlaid strands 2020, 2032 are continuously inlaid along the medial side 2016, along the forefoot region 2008, and along the lateral side 2014.

The strands 2020, 2032 can be inlaid during a knitting process performed by a knitting machine. For example, the strands 2020, 2032 can be inlaid into the knitted component 2040 with each pass of a carriage of the knitting machine, e.g., so that the strands continuously extend along adjacent courses of the knitted component 2040. It should be noted that while a pair of continuous strands 2020, 2032 are inlaid into the knitted component 2040, e.g., either inside the knitted component 2040 or along a surface of the knitted component 2040, a single continuous inlaid strand can be incorporated, or more than two inlaid strands can be incorporated. In different aspects, the inlaid strands 2020, 2032 can be yarns, e.g., high-tenacity yarns, e.g., polyester yarns, e.g., non-elasticated polyester yarns, or can be other types of fibers, cables, filaments, or multi-filaments, e.g., those having a high tensile strength and/or high stretch-resistance. For example, in one aspect, the inlaid strands 2020, 2032 can be a single or multi-filament polyester yarn. This can allow the inlaid strands 2020, 2032 to have a higher tenacity, stretch-resistance, and/or tensile strength than yarns forming the remaining base textile of the knitted component 2040. This configuration can help impart reinforcement and/or containment about the knitted component 2040 in the direction of a common portion.

In addition, looking still at FIG. 20, the lateral and medial sides 2014, 2016 of the knitted component 2040 further include inlaid cables 2023, 2033, respectively, with these cables 2023, 2033 also being selected from higher strength or stretch-resistant materials. The cables 2023, 2033 extend from the outer perimeter 2024, through the knitted component 2040 (e.g., through layers thereof and/or through a tunnel structure thereof), around eyelet/lace openings 2025, 2035, out of the inner perimeter 2034 (e.g., forming loops), extend back into the knitted component 2040, and to the outer perimeter 2024 (e.g., again forming loops), and continue to form a repeating sequence on the lateral and medial sides 2014, 2016 of the knitted component 2040. The cables 2023, 2033 also (like the inlaid strands 2020, 2032) extend about a common portion, e.g., the throat region 2026. The cables 2023, 2033 can thus also extend at least partially at an angle relative to each other, as discussed herein. The inclusion of the cables 2023, 2033 can provide further reinforcement and/or containment on lateral and medial sides 2014, 2016 of the knitted component 2040, among other benefits.

Figure 21:
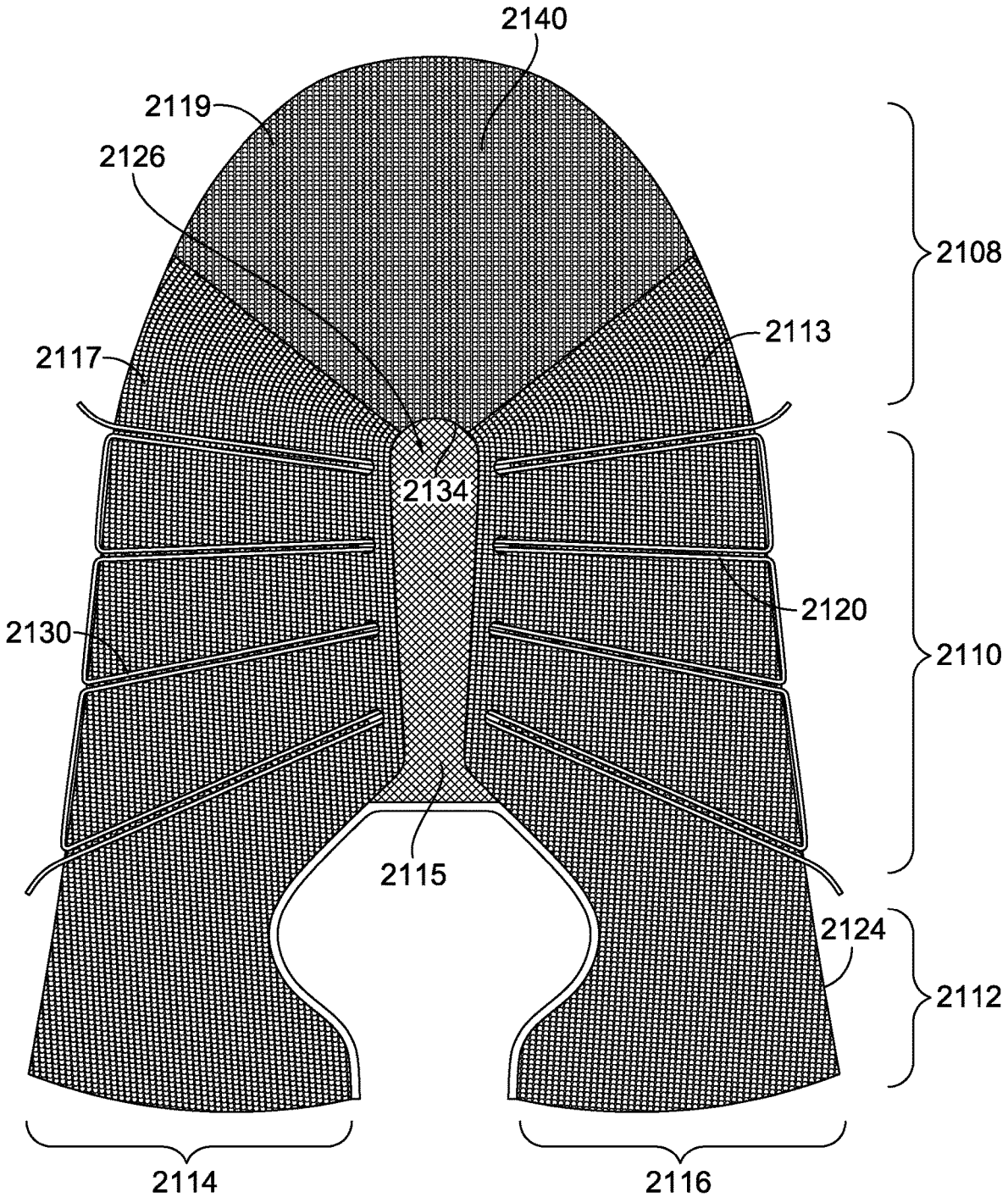
FIG. 21 depicts a knitted component with knit portions having different knitted constructions, in accordance with aspects hereof.

FIG. 21 depicts a knitted component 2140 that includes different sections with different types of knitted constructions, in accordance with aspects hereof. The knitted component 2140 includes a knit element that forms a base textile with inlaid strands 2120, 2130 extending at least partially through the base textile from an outer perimeter 2124 to an inner perimeter 2134. The inlaid strands 2120, 2130 extend about a common portion, e.g., a throat region 2126. In addition, the throat region 2126 also includes a textile 2115 that interconnects the inner perimeter 2134, e.g., forming an overfoot portion. The strands 2120, 2130 inlaid in the base textile can extend generally at an angle relative to each other, e.g., forming at least in part a radial configuration about the common portion of the knitted component 2140.

The knitted component 2140 includes different knit structures in different areas. In this sense, the knitted component 2140 is a composite-type knitted component formed using different knitting processes. The medial side 2116 of the knitted component 2140 has a strand 2120 inlaid within courses of a knit element 2113 that forms a base textile at the medial side 2116, with the courses of the knit element 2113 and the inlaid strand 2120 extending about a common portion of the knitted component 2140, e.g., in a substantially radial configuration. The lateral side 2114 of the knitted component 2140 has a strand 2130 inlaid within courses of a knit element 2117 that forms a base textile at the lateral side 2114, with the courses of the knit element 2117 and the inlaid strand 2130 extending about a common portion of the knitted component 2140, e.g., in a substantially radial configuration. In addition, it can be seen that the forefoot region 2108 includes a differently formed knit element 2119, e.g., one formed with a non-radial configuration. For example, the knit element 2119 can be one that includes horizontally (e.g., left-to-right in FIG. 21) extending knit courses, as opposed to a radial configuration with knit courses extending towards and about a common portion, e.g., at least partially at an angle relative to each other. This multiple knit construction can allow for greater reinforcement and/or containment in the medial and lateral sides 2116, 2114 of the midfoot portion 2110 of the knitted component 2140, while allowing for a looser, more comfort-oriented feel in the forefoot region 2108 of the knitted component 2140, among other benefits.

Figure 22:
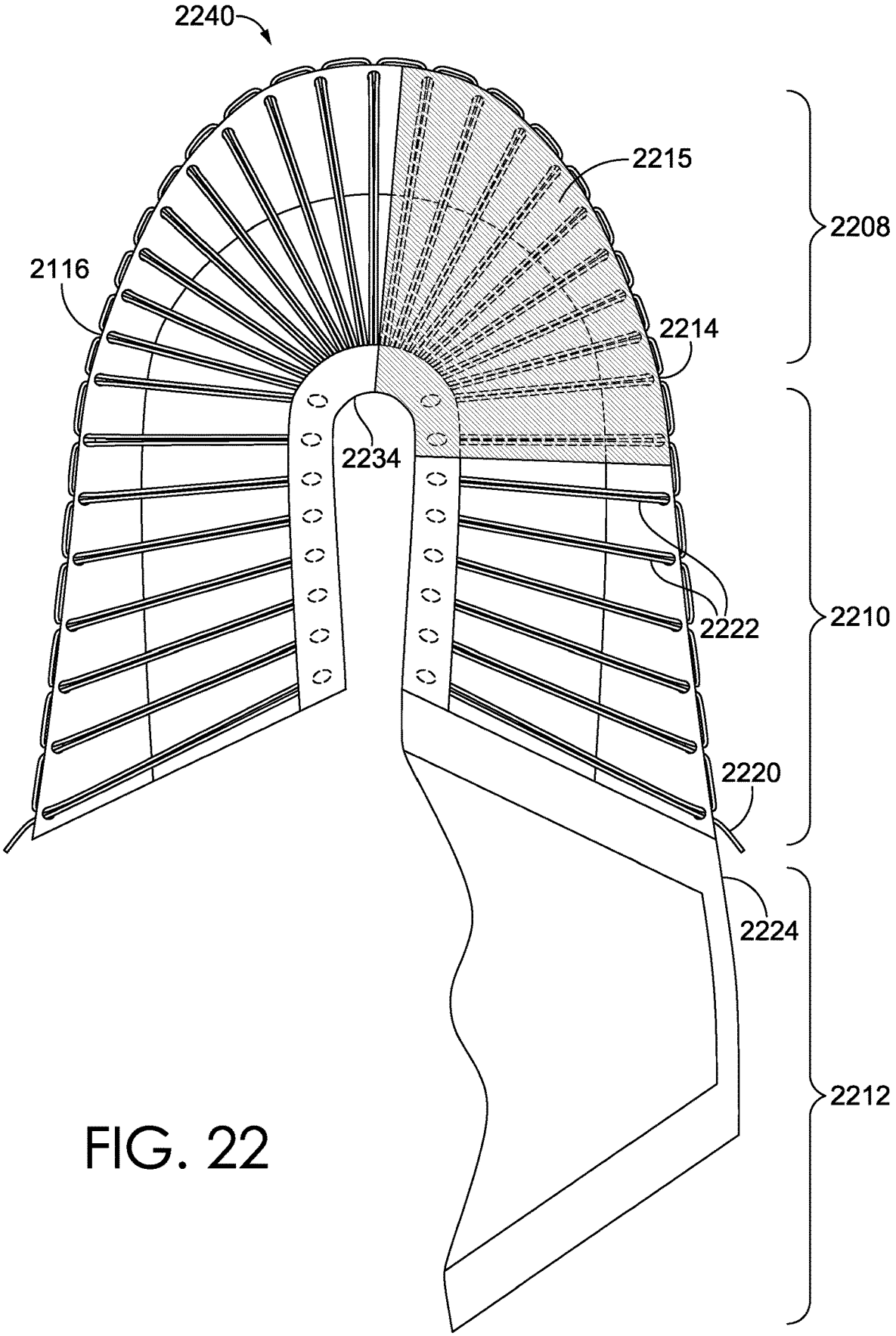
FIG. 22 depicts a knitted component with differently configured areas, in accordance with aspects hereof.

FIG. 22 depicts a knitted component 2240 with differently configured areas, in accordance with aspects hereof. The knitted component 2240 includes elements similar to other knitted components described herein. For example, the knitted component 2240 includes a knit element that forms a base textile and at least one inlaid strand 2220 that extends through the knit element between the outer perimeter 2224 and the inner perimeter 2234, e.g., towards a common portion, e.g., a throat region 2226. The inlaid strand 2220 forms a plurality of strand segments 2222 that extend about the toe area of the forefoot portion 2208, each extending toward the common portion, e.g., the throat region 2226. In one aspect, the strand segments 2222 can form lace loops at the throat region 2226, and can be at least partially exposed through the base textile.

Looking still at FIG. 22, it can be seen that the knitted component 2240 is formed such that portions of the knitted component 2240 include or contain fusible yarns, e.g., yarns formed from thermoplastic polymer materials. In FIG. 22, these fusible yarns are localized in part of the forefoot region 2208, e.g., in this instance on the lateral side 2114 to impart localized properties to the lateral side 2114, e.g., stiffness, stretch-resistance, containment, reinforcement, durability, and other properties. It should be understood that these materials can be integrated at any location on the knitted component 2240 or on other knitted components described herein. The inclusion of these fusible yarns means that heat can be applied at a temperature at or greater than the melting temperature of the fusible yarns, but less than a melting temperature of the yarns forming a remaining portion of the knitted component 2240, thus forming an at least partially fused area 2215 on the knitted component 2240, e.g., located on the inner and/or outer surface of the knitted component 2240. This fused area 2215 can alternatively be on the medial side 2216, or on portions of both the medial and lateral sides 2216, 2214 and/or throughout a toe region, and may cover a larger or smaller portion of the knitted component, in different aspects.

Figure 23A:
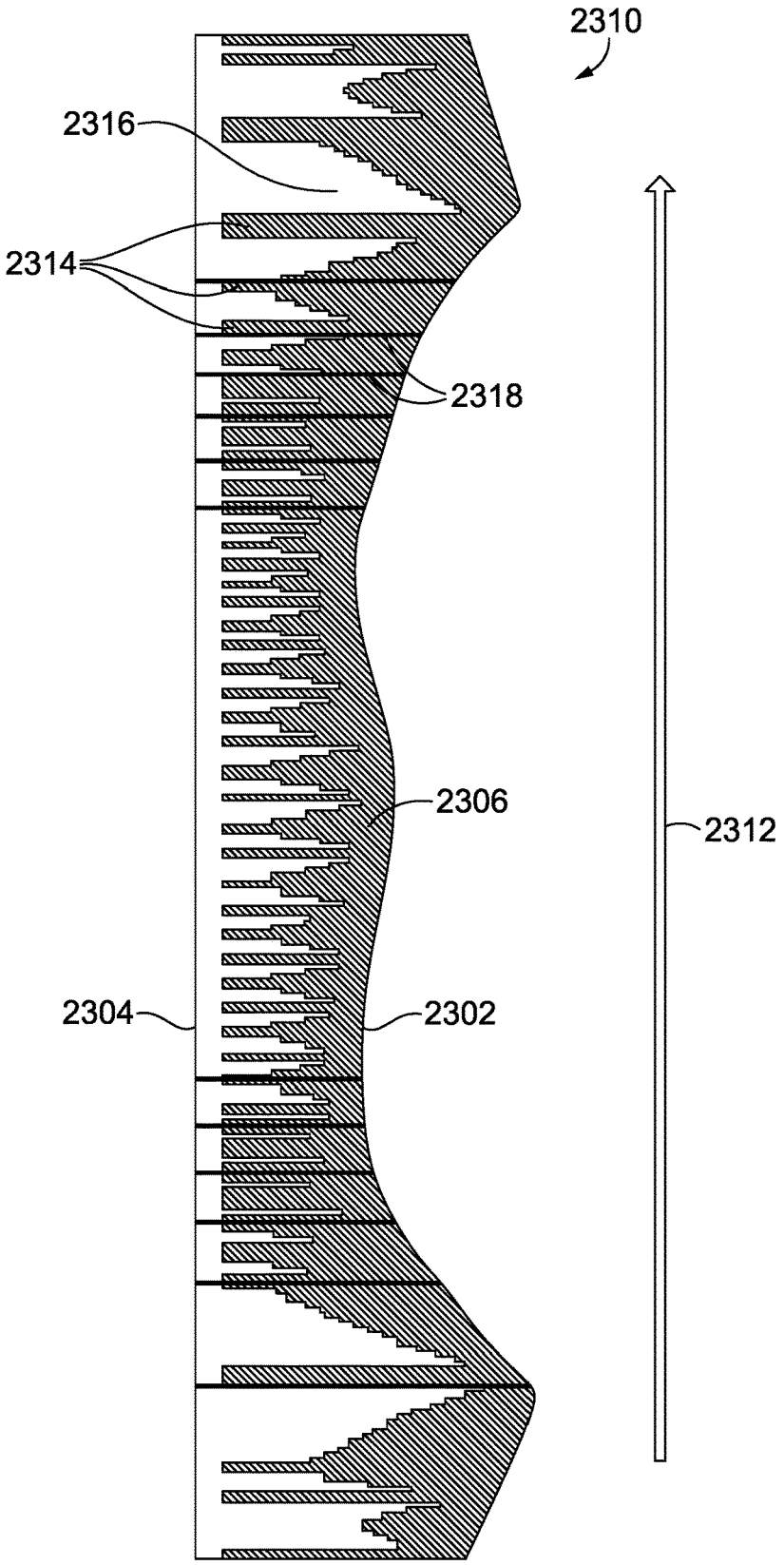
FIG. 23A depicts a knitting diagram, in accordance with aspects hereof.
Figure 23B:
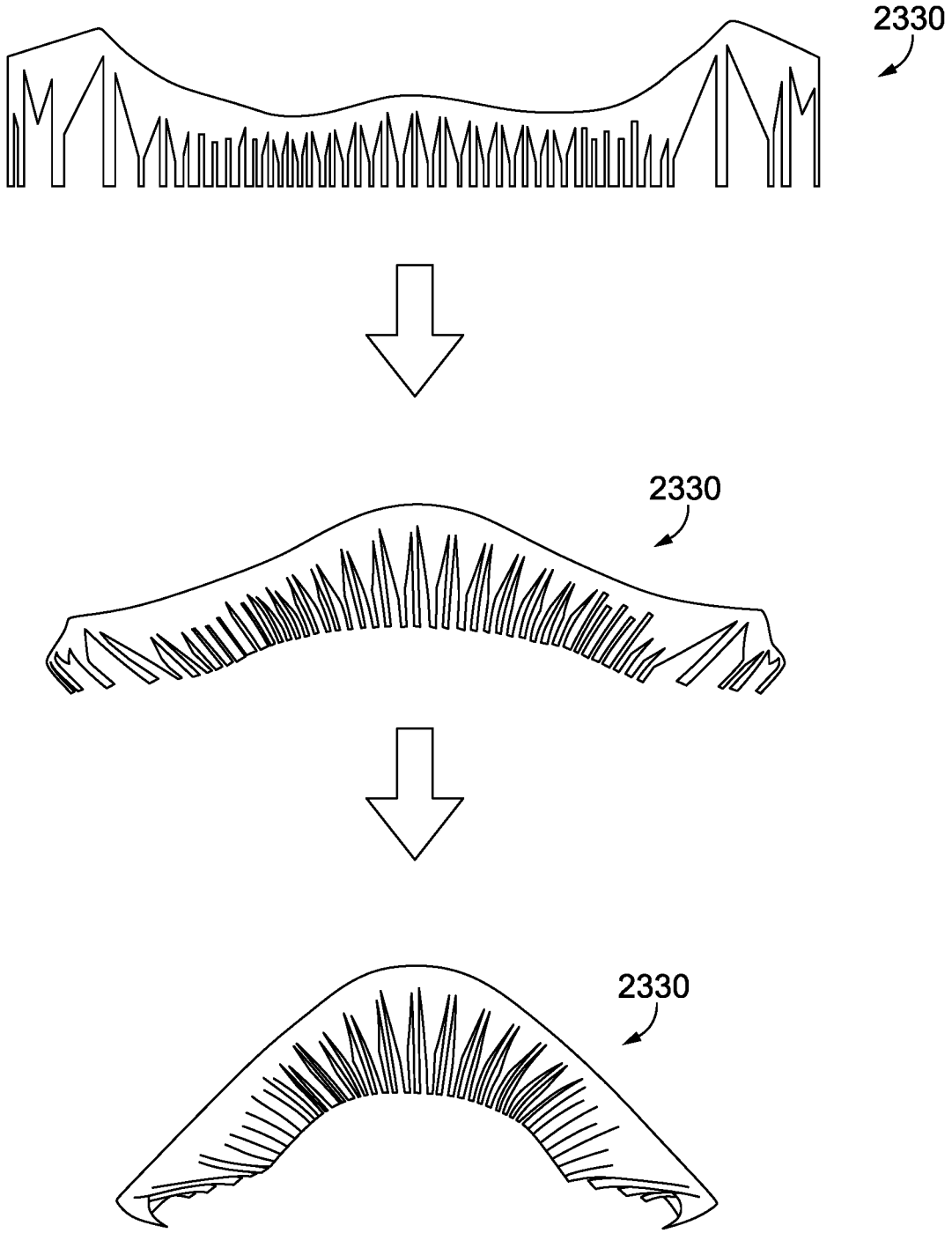
FIG. 23B depicts a sequential formation of a knitted component according to the knitting diagram of FIG. 23A, in accordance with aspects hereof.

FIG. 23A shows a schematic illustration of an example knitting sequence representation 2310 (hereinafter referred to as knitting representation 2310) for knitting a knitted component 2330 shown in FIG. 23B which depicts the knitted component 2330 as it is formed on a knitting machine, e.g., the knitting machine 162 comprising the front and back needle beds 161 and 163 shown in FIG. 3, according to the knitting pattern of FIG. 23A, in accordance with aspects hereof. The knitting representation 2310 shows a knitting direction 2312 for radially knitting or sequentially knitting a heel region, a medial region or a lateral region, a forefoot region, and the other of the medial or lateral region in a sequential manner. Radially knitting or sequentially knitting is further described herein in connection with FIGS. 17 and 18 and in other sections. The knitting representation 2310 may be implemented by the knitting machine, such that the knitting representation 2310 when executed by the knitting machine, generates the knitted component 2330 that forms a part of a footwear upper.

The knitting representation 2310 shows an outer perimeter 2302 of the knitted component 2330 and an inner perimeter 2304 of the knitted component 2330. Further, the knitting representation 2310 shows a plurality of wedges 2314 that may be knitted to form the knitted component. The plurality of wedges 2314 each comprise a first edge at the outer perimeter 2302 and a second edge at the inner perimeter 2304. Further, the first edge is greater in length than the second edge. Furthermore, each of the plurality of wedges 2314 includes at least one course that extends between the outer perimeter 2302 and the inner perimeter 2304. In some examples, the second edge in one or more wedges of the plurality of the wedges 2314 may be formed as an apex.

Each wedge 2314 may be formed by knitting a series of courses, e.g., by starting from a first row, lengths of subsequent courses or subsequent sets of courses in the series of courses increase until a desired width of the knitted component at that region (e.g., midfoot region, forefoot region, etc.) is reached and then decreased until a last row is reached. Further, when the course with the desired length is reached, one or more additional courses may be knit with lengths corresponding to the desired width to form the second edge (at the inner perimeter 2304). In this fashion, a first set of courses with gradually increasing lengths in the knitting direction 2312 can be knit to form a third edge of a wedge 2314 and a second set of courses with gradually decreasing lengths in the knitting direction 2312 can be knit to form a fourth edge of the wedge 2314. As discussed above, in order to generate a wedge-shaped structure, a first set of gradually increasing lengths of courses are knit until the desired width of the fabric is reached. Subsequently, one or more courses at the desired width is knit, and then a second set of gradually decreasing lengths of courses are knit to complete the wedge-shaped structure. Thus, with this process, a wedge is generated that extends between the inner perimeter 2304 and the outer perimeter 2302. The number and/or lengths of the courses may be adjusted to increase or decrease a surface area of the wedge.

By knitting a series of wedges, the knitted component 2330 may be configured to curve or otherwise form an arcuate shape with respect to a common portion, e.g., the inner perimeter 2304 in this example. The inner perimeter 2304 may form at least part of the throat region of an upper in the fully formed knitted component 2330.

Further, as shown in the knitting representation 2310, the forefoot region 2306 comprises a set of wedges that are configured to form a curved structure with a higher curvature, e.g., a smaller radius of curvature. For example, each of the set of wedges in the forefoot region 2306 may have a smaller surface area than the set of wedges in the midfoot area. Additionally, or alternatively, a total number of wedges in the forefoot region 2306 may be increased. Thus, by incorporating a plurality of wedges in the forefoot region 2306, the curved structure of the knitted component 2330 of the upper in the forefoot region 2306 is generated.

In this way, the knitted component 2330 comprises a stack of wedges, where when knitting from a medial to lateral direction, a first set of wedges are configured to form a medial side of the knitted component 2330, a second set of wedges are configured to form a toe region of the knitted component 2330, and a third set of wedges are configured to form a lateral side of the knitted component 2330. In one aspect, additionally, a fourth set of wedges may be included to form a heel region of the knitted component. In a second example, which optionally includes the first example, a number of wedges in the second set of wedges is greater than a number of wedges in the first set of wedges or a number of wedges in the third set of wedges.

In one embodiment, an upper comprises a knitted component having a plurality of interlooped courses defining wedged-shaped portions of the knitted component, each wedge-shaped portion being defined by a portion of an outer perimeter of the knitted component, a portion of an inner perimeter of the knitted component, a first knit course extending from the outer perimeter to the inner perimeter and a second knit course extending from the outer perimeter to the inner perimeter. In a first example of the upper, the portion of the inner perimeter defining a wedge-shaped portion has a shorter length than the portion of the outer perimeter defining the wedge-shaped portion. In a second example of the upper, which optionally includes the first example, each wedge-shaped portion includes full-length courses positioned between the first course and the second course and extending from the outer perimeter to the inner perimeter and includes partial-length courses positioned between the first course and the second course and extending from the outer perimeter and terminating before the inner perimeter. In a third example of the upper, which optionally includes one or more of the first and the second examples, at least some of the wedge-shaped portions of the knitted component form a forefoot region of the upper. In a fourth example of the upper, which optionally includes one or more of the first through third examples, at least some of the wedge-shaped portions of the knitted component form a midfoot region of the upper. In a fifth example of the upper, which optionally includes one or more of the first through fourth examples, at least some of the wedge-shaped portions of the knitted component form a heel region of the upper. In a sixth example of the upper, which optionally includes one or more of the first through fifth examples, the upper is an upper of a footwear article.

The knitting representation 2310 shows one or more inlaid strands 2318 that may be interlooped with one or more courses in the knitted component 2330. The location and number of the inlaid strands (that is, where the inlaid strand is inlaid) may be selected so as to provide a desired level of containment and/or direction of containment. In one example, the location of the inlaid strand may be selected to allow the one or more inlaid strands to align or substantially align with one or more lines of containment, such as the lines of containment along axes 121, 123 discussed in connection with FIG. 3. In another example, additionally or alternatively, a geometry of the wedge (e.g., length of each side of the wedge, surface area, etc.) may be adjusted to position the one or more inlaid strands in a desired location and/or to align or substantially align the inlaid strands with the one or more lines of containment or desired directions of reinforcement.

In FIG. 23A, the knitted rows forming the wedges 2314 are represented according to how those rows will be formed/knitted by the knitting machine. In this sense, the knitted rows include both longer rows and shorter rows. The longer rows (measured left-to-right in FIG. 23A) represents longer knit courses, and the shorter rows (measured left-to-right in FIG. 23A) represent shorter knit courses. The space 2316 located adjacent to and between the knitted rows forming the wedges 2314 represents stitches held or not completed during a knitting process, or rather, unknitted sections of knit courses. The lines in FIG. 23A represent the inlaid strands 2318. The formation of a knitted component 2330 with wedges, e.g., longer and shorter courses along the knitting direction 2312, allows the base textile that is formed on the knitting machine to turn, i.e., naturally form a non-linear, arcuate, and/or radial shape that circumscribes a common portion, location, and/or point. This knitting configuration also allows the inlaid strands 2318 to extend in a similar non-linear, arcuate, and/or radial shape about a common portion, location, and/or point. The formation of a knitted component 2330 based on the knitting sequence 2310 shown in FIG. 23A is depicted in the example of FIG. 23B where it can be seen that the wedges of FIG. 23A result in a radially arranged knitted piece over the course of the knitting process.

The knitted components described herein can be incorporated into different articles, e.g., uppers, articles of footwear, articles of apparel, e.g., hats, caps, shirts, jerseys, jackets, socks, shorts, pants, undergarments such as underwear and bras, athletic support garments, gloves, wrist/arm bands, sleeves, head-bands, or can be incorporated into other articles, such as sports equipment, bags, backpacks, or outdoor recreational equipment or gear, among other contemplated articles.

Clause 1: An upper comprising: a knitted component forming at least a forefoot region and a midfoot region of the upper and having an outer perimeter, the forefoot region being integrally knit with the midfoot region, the forefoot region having a first course extending continuously between the outer perimeter in the forefoot region and a common portion of the knitted component, the midfoot region having a second course extending continuously between the outer perimeter in the midfoot region and the common portion of the knitted component, the first course and the second course extending at an angle relative to each other.

Clause 2: The upper of clause 1, wherein the knitted component forms a heel region of the upper, the heel region having a third course extending continuously between the outer perimeter in the heel region and the common portion of the knitted component.

Clause 3: The upper of clause 1 or 2, wherein the common portion of the knitted component is a throat area of the upper.

Clause 4: The upper of any of clauses 1-3, wherein the common portion of the knitted component is a forward portion of the throat area of the upper.

Clause 5: The upper of any of the clauses 1-4, wherein the knitted component forms a tongue of the upper.

Clause 6: The upper of any of clauses 1-5, wherein the tongue is integrally knitted with at least the forefoot region.

Clause 7: The upper of any of clauses 1-6, wherein the knitted component forms a heel region of the upper and includes a fourth course extending at least partially in the heel region and a fifth course extending at least partially in a forefoot region, the fourth course and the fifth course each extending parallel to an axis extending between a portion of the forefoot region configured to cover a first metatarsal of a wearer to a lateral portion of the heel region.

Clause 8: The upper of any of clauses 1-7, wherein the knitted component forms a heel region of the upper and includes a fourth courses extending at least partially in the heel region and a fifth course extending at least partially in a forefoot region, the fourth course and the fifth course each extending parallel to an axis extending between a portion of the forefoot region configured to cover a fifth metatarsal of the wearer to a medial portion of the heel region.

Clause 9: The upper of any of clauses 1-8, wherein the knitted component further comprises an inlaid strand having a plurality of strand segments, each strand segment extending from the outer perimeter to the common portion.

Clause 10: The upper of any of clauses 1-9, wherein each strand segment extends through the upper from the outer perimeter to the common portion.

Clause 11: The upper of any of clauses 1-10, wherein one or more strand segments within the plurality of strand segments are positioned within the forefoot region of the upper.

Clause 12: The upper of any of clauses 1-11, wherein the common portion comprises a throat area of the upper.

Clause 13: The upper of any of clauses 1-12, wherein the upper comprises a portion of an article of footwear.

Clause 14: A method of manufacturing a knitted component for an upper, the method comprising: forming, on a knitting machine, a first midfoot region of the upper, the first midfoot region forming one of a lateral side and a medial side of the upper; forming, on the knitting machine, a forefoot region of the upper after forming the first midfoot region, the forefoot region being integrally knitted with the first midfoot region; and forming, on the knitting machine, a second midfoot region of the upper after forming the forefoot region, the second midfoot region being integrally knitted with the forefoot region and forming the other of the lateral side and the medial.

Clause 15: The method of clause 14, wherein the knitted component comprises a first course positioned in the forefoot region and extending continuously from an outer perimeter to a common portion of the upper; and a second course positioned in first midfoot region of the upper and extending continuously between the outer perimeter and the common portion.

Clause 16: The method of clause 14 or 15, wherein at least a subset of needles used to form the first midfoot region is used to form the second midfoot region.

Clause 17: The method of any of clauses 14-16, wherein the knitted component comprises a knit element and an inlaid strand extending through one or more courses of the knit element, the inlaid strand being inlaid while the knit element is formed on a plurality of needles of the knitting machine.

Clause 18: The method of any of clauses 14-17, wherein the knitted component is formed such that it includes a plurality of inlaid strands in at least a first portion of the knitted component that extend between an outer perimeter of the upper and a common portion of the upper at an angle relative to each other, the plurality inlaid strands having a higher tenacity than one or more yarns forming a remaining portion of the knitted component.

Clause 19: An upper comprising: a knit element defining at least part of an outer perimeter of the upper and having a plurality of courses extending between the outer perimeter and the throat region; at least ones inlaid strand integrated with the knitted component to form a plurality of strand segments that extend between the outer perimeter and the throat region within respective ones of the plurality of courses of the knitted component, wherein at least a portion of the plurality of strand segments extend at an angle relative to each other.

Clause 20: The upper of clause 19, wherein the at least one inlaid strand is integrated with the knit element such that the plurality of strand segments are spaced apart along a length of the knit element.

Clause 21: The upper of clauses 19 or 20, wherein the plurality of strand segments comprise a midfoot strand segments located in a midfoot region of the upper.

Clause 22: The upper of any of clauses 19-21, wherein the plurality of strand segments comprise heel strand segments that extend from the sole structure to the throat region.

Clause 23: The upper of any of clauses 19-22, wherein adjacent ones of the heel strand segments are spaced further apart than adjacent ones of the forefoot strand segments.

Clause 24: The upper of any of the claims 19-23, wherein a ratio of an average spacing between adjacent ones of the heel strand segments and an average spacing between adjacent ones of the forefoot strand segments is greater than 1.5:1.

Clause 25: The upper of any of clauses 19-24, wherein a ratio of an average spacing between adjacent ones of the heel strand segments and an average spacing between adjacent ones of the forefoot strand segments is between 2:1 and 5:1.

Clause 26: The upper of any of clauses 19-25, wherein a ratio of an average number of courses between adjacent ones of the heel strand segments and adjacent ones of the forefoot strand segments is between greater than 1.5:1.

Clause 27: The upper of any of clauses 19-26, wherein a ratio of an average number of courses between adjacent ones of the heel strand segments and adjacent ones of the forefoot strand segments is between 2:1 and 5:1.

Clause 28: The upper of any of clauses 19-27, wherein the number of strand segments within the plurality of strand segments positioned on a medial side of the upper is the same as the number of strand segments positioned on a lateral side of the upper.

Clause 29: The upper of any of clauses 19-28, wherein the number of strand segments within the plurality of strand segments positioned on a medial side of the upper is different than the number of strand segments positioned on a lateral side of the upper.

Clause 30: The upper of any of clauses 19-29, wherein strand segments within the plurality of strand segments positioned on a medial side of the upper and strand segments positioned on a lateral side of the upper are positioned symmetrically relative to a longitudinal axis of the upper.

Clause 31: The upper of any of clauses 19-31, wherein strand segments within the plurality of strand segments positioned on a medial side of the upper and strand segments positioned on a lateral side of the upper are positioned asymmetrically relative to a longitudinal axis of the upper.

Clause 32: The upper of any of clauses 19-31, wherein the common portion is a forward half of the throat region.

Clause 33: The upper of any of the claims 19-32, wherein the common portion is a rearward half of the throat region.

Clause 34: A knitted component for an upper comprising: a knit element having an outer perimeter that defines a lower edge of the knitted component and a pair of heel edges and an inner perimeter that defines at least one of a throat opening and an ankle opening, the knit element having a plurality of courses extending between the outer perimeter and the inner perimeter; and one or more inlaid strands integrated with the knit element, the one or more inlaid strands forming a plurality of strand segments that extend within respective ones of the plurality of courses of the knit element between the outer perimeter and the inner perimeter.

Clause 35: The knitted component of clause 34, wherein the continuous strand is integrated within the knitted component so that the plurality of strand segments are spaced apart courses along a length of the knitted component.

Clause 36: The knitted component of clause 34 or 35, wherein the knitted component comprises a forefoot region, a midfoot region, and a heel region, and the plurality of strand segments comprise one or more of forefoot strand segments, midfoot strand segments, and heel strand segments.

Clause 37: The knitted component of any of clauses 34-36, wherein the knitted component comprises a medial side and a lateral side, and wherein the one or more inlaid strands form a first plurality of strands on the medial side and wherein the one or more inlaid strands form a second plurality of strands on the lateral side.

Clause 38: The knitted component of any of clauses 34-37, wherein a ratio of an average number of courses between adjacent ones of the heel strand segments and adjacent ones of the forefoot strand segments is between greater than 1.5:1 or between 2:1 and 5:1.

Clause 39: The knitted component of any of clauses 34-38, wherein knitted component comprises a medial side and lateral side, and wherein the number of strand segments within the plurality of strand segments on the medial side is the same as the number of strand segments on the lateral side.

Clause 40: The knitted component of any of clauses 34-39, wherein knitted component comprises a medial side and lateral side, and wherein the number of strand segments within the plurality of strand segments on the medial side strand segments is different than the number of strand segments on the lateral side.

Clause 41: A method of forming an article of footwear comprising: forming at least a portion of an upper by knitting a knit element, the knit element comprising a plurality of courses extending between an outer perimeter and an inner perimeter, the outer perimeter defining a lower portion of the upper and the inner perimeter defining an upper portion of the upper; and integrating a continuous strand into the knit element during knitting to form a plurality of strand segments that extend within respective ones of the plurality of courses of the knit element between the outer perimeter and the inner perimeter.

Clause 42: The method of clause 42, further comprising securing at least a portion of the lower portion of the knit element to a sole structure.

Clause 43: The method of clause 41 or 42, wherein the knitting of the knit element comprises sequentially knitting a medial side and a lateral side of the knit element to form a single knitted component that can be joined together at a pair of edges in a heel region.

Clause 44: The method of any of clauses 41-44, wherein the continuous strand is integrated with the knitted component by inlaying the continuous strand through courses within the plurality of courses.

Clause 45: The method of any of clauses 41-45, wherein the article of footwear comprises a forefoot region, a midfoot region, and a heel region, and integrating the continuous strand to form a plurality of strand segments comprises forming forefoot strand segments that extend from the sole structure to a throat region of the upper.

Clause 46: The method of any of clauses 41-45, wherein the article of footwear comprises a forefoot region, a midfoot region, and a heel region, and integrating the continuous strand to form a plurality of strand segments comprises forming forefoot strand segments that extend from the sole structure to the throat region, midfoot strand segments that extend from the sole structure to the throat region, and heel strand segments that extend from the sole structure to the throat region.

Clause 47: The method of any of clauses 41-46, wherein adjacent ones of the heel strand segments are spaced further apart than adjacent ones of the forefoot strand segments.

Clause 48: The method of any of clauses 41-47, wherein a ratio of an average spacing between adjacent ones of the heel strand segments and an average spacing between adjacent ones of the forefoot strand segments is greater than 1.5:1 or between 2:1 and 5:1.

Clause 49: The method of any of clauses 41-48, wherein a ratio of an average number of courses between adjacent ones of the heel strand segments and adjacent ones of the forefoot strand segments is between greater than 1.5:1, or between 2:1 and 5:1.

Clause 50: The method of any of clauses 41-49, wherein the article of footwear comprises a medial side and lateral side, and wherein the number of strand segments within the plurality of strand segments positioned on the medial side is the same as the number of strand segments positioned on the lateral side.

Clause 51: The method of any one of clauses 41-50, wherein the article of footwear comprises a medial side and lateral side, and wherein the number of strand segments within the plurality of strand segments positioned on the medial side is different than the number of strand segments positioned on the lateral side.

Clause 52: The method of any of clauses 41-51, wherein the article of footwear comprises a medial side and lateral side, and wherein strand segments within the plurality of strand segments positioned on the medial side strand and strand segments positioned on the lateral side are positioned symmetrically relative to a longitudinal axis of the article of footwear.

Clause 53: The method of any one of claims 41-52, wherein the article of footwear comprises a medial side and lateral side, and wherein strand segments of the plurality of strand segments positioned on the medial side and strand segments of the plurality of strand segments positioned on the lateral side are positioned asymmetrically relative to a longitudinal axis of the article of footwear.

Clause 54: A knitted component comprising a plurality of knitted structures arranged in an at least partially radial configuration.

Clause 55: The knitted component of clause 54, further comprising an article incorporating the knitted component.

Clause 56: The knitted component of clause 55, wherein the article is an article of footwear or an article of apparel.

Clause 57: An upper, comprising a knitted component having a plurality of interlooped courses defining wedged-shaped portions of the knitted component, each wedge-shaped portion being defined by a portion of an outer perimeter of the knitted component, a portion of an inner perimeter of the knitted component, a first knit course extending from the outer perimeter to the inner perimeter and a second knit course extending from the outer perimeter to the inner perimeter.

Clause 58: The upper of clause 57, wherein the portion of the inner perimeter defining a wedge-shaped portion has a shorter length than the portion of the outer perimeter defining the wedge-shaped portion.

Clause 59: The upper of clause 57 or 58, wherein each wedge-shaped portion includes full-length courses positioned between the first course and the second course and extending from the outer perimeter to the inner perimeter and includes partial-length courses positioned between the first course and the second course and extending from the outer perimeter and terminating before the inner perimeter.

Clause 60: The upper of any of clauses 57-59, wherein at least some of the wedge-shaped portions of the knitted component form a forefoot region of the upper.

Clause 61: The upper of any of clauses 57-60, wherein at least some of the wedge-shaped portions of the knitted component form a midfoot region of the upper.

Clause 62: The upper of any of clauses 57-60, wherein at least some of the wedge-shaped portions of the knitted component form a heel region of the upper.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and sub-combinations are of utility and may be employed without reference to other features and sub-combinations and are contemplated within the scope of the claims. Not all steps listed in the various figures need be carried out in the specific order described.

What is claimed is:

1. An upper, comprising:

a knitted component that is flat knitted, the knitted component comprising:

a forefoot region comprising part of an outer perimeter edge of the upper; and a midfoot region comprising a throat region of the upper, the forefoot region and the midfoot region being integrally knitted, and the knitted component comprising a plurality of radially-knitted courses extending from the throat region to the outer perimeter edge in at least the forefoot region, the plurality of radially-knitted courses extending at an angle to each other, such that a spacing between the plurality of radially-knitted courses increases between the throat region and the outer perimeter edge.

2. The upper of claim 1, wherein the knitted component forms a heel region of the upper, the heel region comprising a portion of the plurality of radially-knitted courses that extend continuously from the throat region to the outer perimeter edge in the heel region.

3. The upper of claim 1, wherein the plurality of radially-knitted courses align with lines of containment in at least the forefoot region of the upper.

4. The upper of claim 1, wherein a textile interconnects an inner perimeter of the throat region.

5. The upper of claim 1, wherein the knitted component further comprises an inlaid strand having a plurality of strand segments, wherein the plurality of strand segments extend radially from the throat region to the outer perimeter edge in at least the forefoot region, such that a spacing between the plurality of strand segments increases between the throat region and the outer perimeter edge in the forefoot region.

6. The upper of claim 5, wherein the plurality of strand segments align with lines of containment in at least the forefoot region.

7. An article of footwear comprising the upper of claim 1 secured to a sole structure.

8. An upper, comprising:

a knit element that is flat knitted, the knit element comprising:

a forefoot region of the upper comprising part of an outer perimeter edge of the upper;

a midfoot region of the upper comprising a throat region and being integrally knitted with the forefoot region, the knit element comprising a plurality of radially-knitted courses extending from the throat region to the outer perimeter edge in at least the forefoot region, the plurality of radially-knitted courses extending at an angle to each other, such that a spacing between the plurality of radially-knitted courses increases between the throat region and the outer perimeter edge of the upper; and at least one inlaid strand integrated with the knit element and comprising a plurality of strand segments that extend between the throat region and the outer perimeter edge in at least the forefoot region along respective courses of the plurality of radially-knitted courses of the knit element, wherein at least a portion of the plurality of strand segments extend at an angle relative to each other.

9. The upper of claim 8, wherein the at least one inlaid strand is integrated with the knit element such that the plurality of strand segments are spaced apart along a length of the knit element.

10. The upper of claim 8, wherein the plurality of strand segments comprise a plurality of midfoot strand segments located in the midfoot region of the upper.

11. The upper of claim 8, wherein the plurality of strand segments comprise a plurality of heel strand segments that extend from the outer perimeter edge to the throat region in a heel region of the upper.

12. An upper comprising a knitted component that is flat knitted, the knitted component comprising:

a knit element having an outer perimeter that defines a lower edge of the knitted component and a pair of heel edges and an inner perimeter that defines at least one of a throat opening and an ankle opening, the knit element having a plurality of radially-knitted courses extending from the inner perimeter to the outer perimeter of the knit element, the plurality of radially-knitted courses extending at an angle to each other, such that a spacing between the plurality of radially-knitted courses increases between the inner perimeter and the outer perimeter; and one or more inlaid strands integrated with the knit element, the one or more inlaid strands forming a plurality of strand segments that extend within respective courses of the plurality of radially-knitted courses of the knit element and between the outer perimeter and the inner perimeter.

13. The upper of claim 12, wherein the one or more inlaid strands are integrated within the knit element so that the plurality of strand segments are spaced apart along a length of the knit element.

14. The upper of claim 12, further comprising a plurality of wedge portions that include the plurality of radially-knitted courses, each wedge portion comprising a combination of longer and shorter knitted courses.

15. The upper of claim 12, wherein the one or more inlaid strands form a first plurality of strand segments on a medial side of the upper and a second plurality of strand segments on a lateral side of the upper.

16. The upper of claim 15, wherein the first plurality of strand segments located on the medial side and the second plurality of strand segments located on the lateral side have an equal number of strand segments.

17. An article of footwear comprising the upper comprising the knitted component of claim 12, the upper secured to a sole structure.

18. The upper of claim 12, wherein at least some of the plurality of radially-knitted courses are configured to form one or more wedge portions, each wedge portion of the one or more wedge portions having a first edge at the outer perimeter, a second edge at the inner perimeter, and at least one radially-knitted course of the plurality of radially-knitted courses that extends from the outer perimeter to the inner perimeter.

19. The upper of claim 18, wherein at least one of the one or more wedge portions is located in a forefoot region of the upper.

20. The upper of claim 1, wherein one or more continuous yarns form the plurality of radially-knitted courses in the forefoot region.

21. The upper of claim 8, wherein one or more continuous yarns form the plurality of radially-knitted courses in the forefoot region.

22. The upper of claim 12, wherein one or more continuous yarns form the plurality of radially-knitted courses.

23. An article of footwear, comprising:

an upper, comprising:

a knitted component, comprising:

a forefoot region that comprises part of an outer perimeter edge of the upper; and a throat region that comprises at least part of an inner perimeter edge of the upper, wherein the forefoot region and the throat region are integrally knitted, and wherein a plurality of radially-knitted courses extend from the throat region to the outer perimeter edge in at least the forefoot region, wherein the plurality of radially-knitted courses extend at an angle to each other, such that a spacing between the plurality of radially-knitted courses increases towards the outer perimeter edge, wherein the plurality of radially-knitted courses extend between the inner perimeter edge and the outer perimeter edge integrally across a lateral side of the upper, across the forefoot region, and across a medial side of the upper; and a sole structure secured to the upper.

24. The article of footwear of claim 23, further comprising a plurality of strand segments that are inlaid in the knitted component and that extend through at least some of the plurality of radially-knitted courses.

* * * * *